US010719034B1

(12) United States Patent
Kasukawa

(10) Patent No.: US 10,719,034 B1
(45) Date of Patent: Jul. 21, 2020

(54) DEVELOPING DEVICE AND IMAGE FORMING APPARATUS

(71) Applicant: TOSHIBA TEC KABUSHIKI KAISHA, Shinagawa-ku, Tokyo (JP)

(72) Inventor: Masayuki Kasukawa, Misato Saitama (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/358,837

(22) Filed: Mar. 20, 2019

(51) Int. Cl.
*G03G 15/08* (2006.01)

(52) U.S. Cl.
CPC ..... *G03G 15/0891* (2013.01); *G03G 15/0865* (2013.01)

(58) Field of Classification Search
CPC ..... G03G 15/0893; G03G 15/0877; G03G 15/0891; G03G 15/0889; G03G 2215/0827; G03G 2215/0833
See application file for complete search history.

(56) References Cited

U.S. PATENT DOCUMENTS

2011/0158700 A1* 6/2011 Iwata ..... G03G 15/0089 399/254
2012/0243913 A1* 9/2012 Murata ..... G03G 15/0875 399/263
2015/0078786 A1* 3/2015 Tamaki ..... G03G 15/0889 399/254
2016/0259269 A1* 9/2016 Tanaka ..... G03G 15/0893

FOREIGN PATENT DOCUMENTS

JP 2007-183408 7/2007

* cited by examiner

*Primary Examiner* — Walter L Lindsay, Jr.
*Assistant Examiner* — Jessica L Eley
(74) *Attorney, Agent, or Firm* — Amin, Turocy & Watson, LLP

(57) ABSTRACT

According to one embodiment, a developing device includes a developer storage unit, a toner supply unit, a magnet roller, a first stirring screw, and a second stirring screw. The developer storage unit is configured to be made to be able to circulate and convey a developer. The toner supply unit supplies a toner to the developer storage unit. The magnet roller adsorbs the developer. The first stirring screw conveys the developer from a second opening portion to a first opening portion along a longitudinal direction. The second stirring screw includes a rotating shaft, a screw, a paddle, and a protrusion. The screw conveys the developer from the first opening portion to the second opening portion along the longitudinal direction by rotation. The paddle protrudes from the rotating shaft to a lateral side. The paddle stirs the developer by rotation. The protrusion protrudes from the paddle in the rotating direction.

19 Claims, 13 Drawing Sheets

DEVELOPING DEVICE AND IMAGE FORMING APPARATUS

FIELD

Embodiments described herein relate generally to a developing device and an image forming apparatus

BACKGROUND

A developing device of an image forming apparatus stirs a developer containing a toner and a carrier, thereby triboelectrically charging the toner. The charged toner is adsorbed on a magnet roller and thereafter transferred to a photoconductive drum.

In this manner, the developing device causes the toner contained in the developer to adhere to the photoconductive drum according to an electrostatic latent image. When the toner is consumed by development, the toner is supplied to the developing device. The developing device includes a stirring screw. The stirring screw stirs the developer and the suppled toner, and also circulates and conveys the developer in the developing device.

However, the suppled toner does not mix into the existing developer and is conveyed along the surface on the developer in some cases. In such a case, mere stirring of the toner is insufficient.

The toner which is insufficiently stirred is not sufficiently charged, and image formation is hardly accomplished.

DETAILED DESCRIPTION

A developing device of an embodiment includes a developer storage unit, a toner supply unit, a magnet roller, a first stirring screw, and a second stirring screw. The developer storage unit includes a first storage chamber and a second storage chamber. The first storage chamber and the second storage chamber store a developer. In the first storage chamber and the second storage chamber, a first opening portion and a second opening portion are formed in both end portions in a longitudinal direction. The developer storage unit is configured to be made to be able to circulate and convey the developer through the first opening portion and the second opening portion. The toner supply unit supplies a toner to the developer storage unit. The magnet roller adsorbs the developer. The magnet roller is disposed extending in the longitudinal direction in an upper portion of the first storage chamber. The first stirring screw is disposed along the longitudinal direction below the magnet roller inside the first storage chamber. The first stirring screw conveys the developer from the second opening portion to the first opening portion along the longitudinal direction. The second stirring screw includes a rotating shaft, a screw, a paddle, and a protrusion. The rotating shaft is disposed parallel to the first stirring screw inside the second storage chamber. The screw protrudes from the rotating shaft to a lateral side. The screw conveys the developer from the first opening portion to the second opening portion along the longitudinal direction by rotation around the central axis line of the rotating shaft. The paddle protrudes from the rotating shaft to a lateral side. The paddle stirs the developer by rotation. The protrusion protrudes from the paddle in the rotating direction.

Embodiments

Hereinafter, a developing device and an image forming apparatus of embodiments will be described with reference to the drawings.

Figure 1:
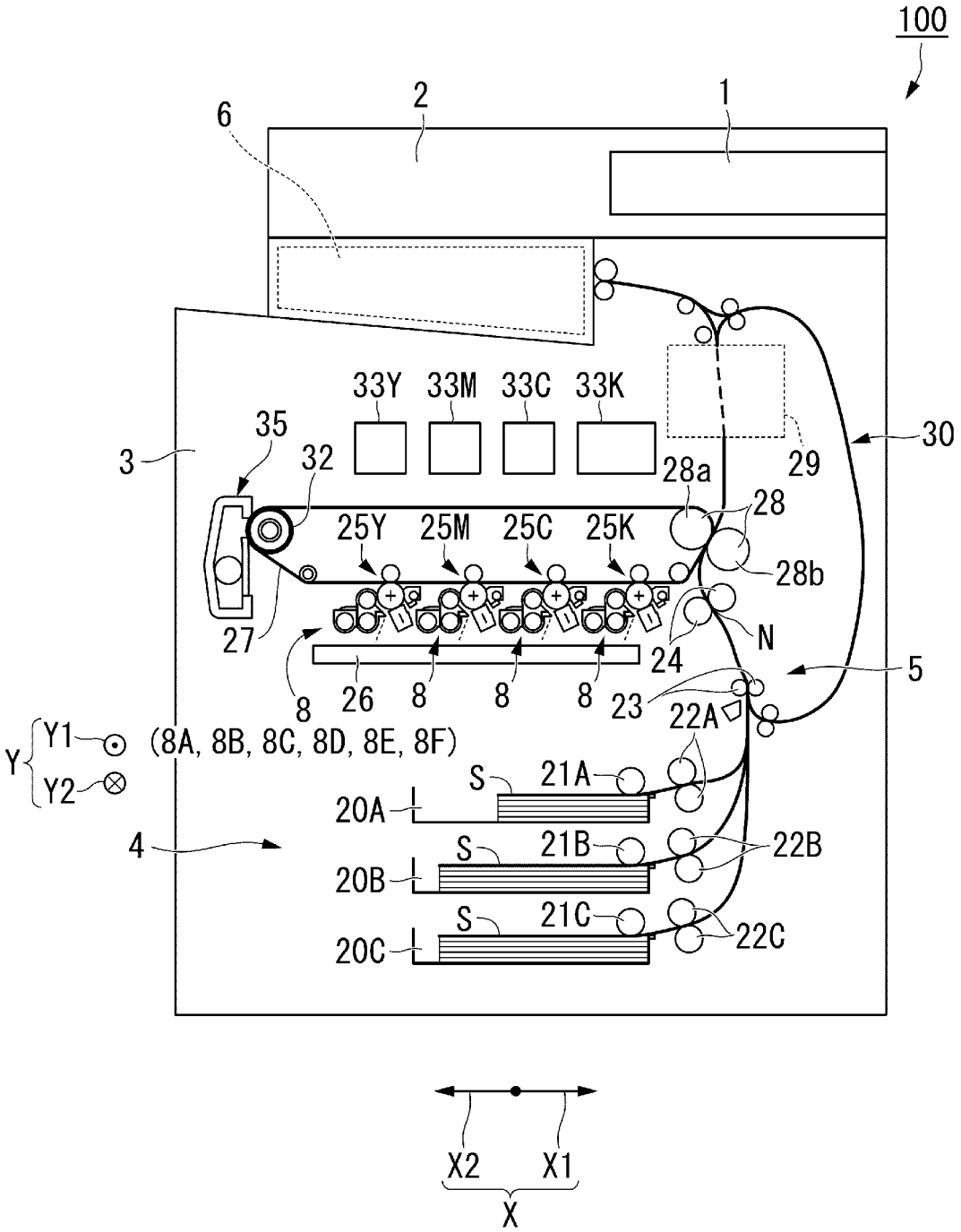
FIG. 1 is a schematic cross-sectional view showing an overall configuration example of an image forming apparatus of an embodiment.

FIG. 1 is a schematic cross-sectional view showing an overall configuration example of an image forming apparatus of an embodiment. In the respective drawings hereinbelow, the same components are denoted by the same reference numerals unless otherwise specified.

As shown in FIG. 1, an image forming apparatus 100 of the embodiment includes a control panel 1, a scanner unit 2, a printer unit 3, a sheet feed unit 4, a conveying unit 5, and a body control unit 6.

Hereinafter, when referring to a relative position in the image forming apparatus 100, X1 direction, X2 direction, Y1 direction, and Y2 direction shown in the drawings are used in some cases. The X1 direction is a direction directed from left to right when standing in front of the image forming apparatus 100 (on the front side of the sheet of FIG. 1). The X2 direction is an opposite direction to the X1 direction. The Y1 direction is a direction directed from the rear face to the front face of the image forming apparatus 100. The Y2 direction is an opposite direction to the Y1 direction. When the direction is irrespective of the X1 (Y1) direction or the X2 (Y2) direction or both directions are included, the direction is simply referred to as "X (Y) direction".

The control panel 1 makes the image forming apparatus 100 act by being operated by an operator.

The scanner unit 2 reads the image information of an object to be copied as the contrast of light. The scanner unit 2 outputs the read image information to the printer unit 3.

The printer unit 3 forms an image on a sheet S based on the image information from the scanner unit 2 or from the outside.

The printer unit 3 forms an output image (toner image) with a developer containing a toner. The printer unit 3 transfers the toner image onto the surface of the sheet S. The printer unit 3 applies heat and pressure to the toner image on the surface of the sheet S, thereby fixing the toner image to the sheet S.

The sheet feed unit 4 feeds the sheet S one by one to the printer unit 3 in accordance with the timing of forming the toner image by the printer unit 3.

The sheet feed unit 4 includes a plurality of paper feed cassettes 20A, 20B, and 20C. Each of the paper feed cassettes 20A, 20B, and 20C can store the sheets S whose size and type are set in advance for each cassette in a stacked state.

The paper feed cassettes 20A, 20B, and 20C can be attached to and detached from a body portion of the sheet feed unit 4. The paper feed cassettes 20A, 20B, and 20C are disposed in a stacked state in this order from the top to the bottom when being attached to the sheet feed unit 4.

The sheet feed unit 4 includes pickup rollers 21A, 21B, and 21C corresponding to the respective paper feed cassettes 20A, 20B, and 20C. The pickup rollers 21A, 21B, and 21C each pick up the sheet S loaded in the paper feed cassettes 20A, 20B, and 20C, respectively, one by one. The pickup rollers 21A, 21B, and 21C each pick up the uppermost sheet S in the loading direction among the loaded sheets S. The pickup rollers 21A, 21B, and 21C convey the picked up sheet S to the conveying unit 5 toward the printer unit 3.

The conveying unit 5 includes a conveying roller 23 and a resist roller 24. The conveying unit 5 conveys the sheet S fed from the pickup rollers 21A, 21B, and 21C to the resist roller 24. The resist roller 24 conveys the sheet S in accordance with the timing of transferring the toner image to the sheet S by the printer unit 3.

The conveying roller 23 abuts the front end in the conveying direction of the sheet S against a nip N of the resist roller 24. The conveying roller 23 bends the sheet S so as to adjust the position of the front end of the sheet S in the conveying direction.

The resist roller 24 aligns the front end of the sheet S sent from the conveying roller 23 in the nip N. Further, the resist roller 24 conveys the sheet S toward the below-mentioned transfer unit 28.

The printer unit 3 includes image forming units 25Y, 25M, 25C, and 25K, alight exposure unit 26, an intermediate transfer belt 27, a transfer unit 28, a fixing device 29, and a transfer belt cleaning unit 35.

The image forming units 25Y, 25M, 25C, and 25K are disposed in this order in the X1 direction.

Each of the image forming units 25Y, 25M, 25C, and 25K forms a toner image to be transferred to the sheet S on the intermediate transfer belt 27.

Each of the image forming units 25Y, 25M, 25C, and 25K has a photoconductive drum. The image forming units 25Y, 25M, 25C, and 25K form toner images of yellow, magenta, cyan, and black on the corresponding photoconductive drums 7, respectively.

On the circumference of each of the photoconductive drums 7, a charger, a developing device 8, a transfer roller, a cleaning unit, and a charge neutralizer are disposed. The transfer roller is opposed to the photoconductive drum 7. The intermediate transfer belt 27 is held between the transfer roller and the photoconductive drum 7. The light exposure unit 26 is disposed below the charger and the developing device.

A detailed configuration of each of the developing devices 8 will be described later.

Toner cartridges 33Y, 33M, 33C, and 33K are disposed above the image forming units 25Y, 25M, 25C, and 25K, respectively. In the toner cartridges 33Y, 33M, 33C, and 33K, toners of yellow, magenta, cyan, and black are stored, respectively.

The toner cartridges 33Y, 33M, 33C, and 33K communicate with the developing devices 8 of the image forming units 25Y, 25M, 25C, and 25K through the below-mentioned toner supply tubes 34 (not shown in FIG. 1).

In each of the toner cartridges 33Y, 33M, 33C, and 33K and the respective toner supply tubes 34, a toner conveying mechanism (not shown) for sending the toner to the developing device 8 is provided.

The respective toners in the toner cartridges 33Y, 33M, 33C, and 33K are supplied to the respective developing devices 8 through the toner supply tubes 34 (not shown).

The light exposure unit 26 irradiates a laser beam onto the surface of each of the charged photoconductive drums 7. The emission of the laser beam is controlled based on the image information. The light exposure unit 26 can also adopt a configuration in which LED light is irradiated in place of the laser beam.

The light exposure unit 26 is supplied with image information corresponding to each of yellow, magenta, cyan, and black.

The light exposure unit 26 forms electrostatic latent images based on the image information on the surfaces of the respective photoconductive drums 7.

The intermediate transfer belt 27 is composed of an endless belt. Tension is applied to the intermediate transfer belt 27 by a plurality of rollers abutting against the inner circumferential face. The intermediate transfer belt 27 is stretched into a flat shape. The inner circumferential face of the intermediate transfer belt 27 comes into contact with a support roller 28*a* at a position in the X1 direction farthest in the stretching direction. The inner circumferential face of the intermediate transfer belt 27 comes into contact with a transfer belt roller 32 at a position in the X2 direction farthest in the stretching direction.

The support roller 28*a* forms part of the below-mentioned transfer unit 28. The support roller 28*a* guides the intermediate transfer belt 27 at a secondary transfer position.

The transfer belt roller 32 guides the intermediate transfer belt 27 at a cleaning position.

On the lower face side in the drawing of the intermediate transfer belt 27, the image forming units 25Y, 25M, 25C, and 25K excluding the transfer rollers are disposed in this order in the X1 direction. The image forming units 25Y, 25M, 25C, and 25K are disposed spaced apart from one another in a region between the transfer belt roller 32 and the support roller 28*a*.

The respective developing devices 8 of the image forming units 25Y, 25M, 25C, and 25K store the developers containing the toners of yellow, magenta, cyan, and black, respectively. However, the developers 8 mutually have the same configuration except that the developers are different.

The respective developing devices 8 are disposed opposed in the X2 direction to the respective photoconductive drums 7 of the image forming units 25Y, 25M, 25C, and 25K. The respective developing devices 8 develop the electrostatic latent images formed on the photoconductive drums 7 which the respective developing devices 8 are opposed to. As a result, toner images are formed on the respective photoconductive drums 7.

The respective transfer rollers of the image forming units 25Y, 25M, 25C, and 25K transfer (primarily transfer) the toner images on the surfaces of the respective photoconductive drums 7 onto the intermediate transfer belt 27.

When the toner images reach primary transfer positions, a transfer bias is applied to the respective transfer rollers.

The respective cleaning units of the image forming units 25Y, 25M, 25C, and 25K remove the untransferred toner on the surfaces of the respective photoconductive drums 7 after the primary transfer by scraping or the like.

The respective charge neutralizers of the image forming units 25Y, 25M, 25C, and 25K irradiates light onto the surfaces of the respective photoconductive drums 7 after passing through the cleaning units. The respective charge neutralizers of the image forming units 25Y, 25M, 25C, and 25K neutralize the charge on the photoconductive drums 7 which the respective charge neutralizers are opposed to.

On the intermediate transfer belt 27, the transfer unit 28 is disposed at a position adjacent to the image forming unit 25K.

The transfer unit 28 includes the support roller 28*a* and a secondary transfer roller 28*b*. The secondary transfer roller 28*b* and the support roller 28*a* hold the intermediate transfer belt 27 therebetween. The position where the secondary transfer roller 28*b* and the intermediate transfer belt 27 come into contact with each other is a secondary transfer position.

The transfer unit 28 transfers the charged toner image on the intermediate transfer belt 27 onto the surface of the sheet S at the secondary transfer position. The transfer unit 28 applies a transfer bias to the secondary transfer position. The transfer unit 28 transfers the toner image on the intermediate transfer belt 27 to the sheet S by the transfer bias.

The fixing device 29 applies heat and pressure to the sheet S. The fixing device 29 fixes the toner image transferred to the sheet S by the heat and the pressure.

The transfer belt cleaning unit 35 is opposed to the transfer belt roller 32. The transfer belt cleaning unit 35 holds the intermediate transfer belt 27 therebetween. The transfer belt cleaning unit 35 scrapes the toner on the surface of the intermediate transfer belt 27. The transfer belt cleaning unit 35 collects the scraped toner in a waste toner tank.

The printer unit 3 includes a reversing unit 30. The reversing unit 30 reverses the sheet S discharged from the fixing device 29 by switchback. The reversing unit 30 conveys the reversed sheet S into a conveying guide on the upstream side of the resist roller 24 again. The reversing unit 30 reverses the sheet S for forming an image on the reverse side.

The body control unit 6 controls the respective device portions of the image forming apparatus 100. The control performed by the body control unit 6 includes control of stirring and conveying the developer in the respective developing devices 8.

Next, a detailed configuration of the developing device 8 will be described.

Figure 2:
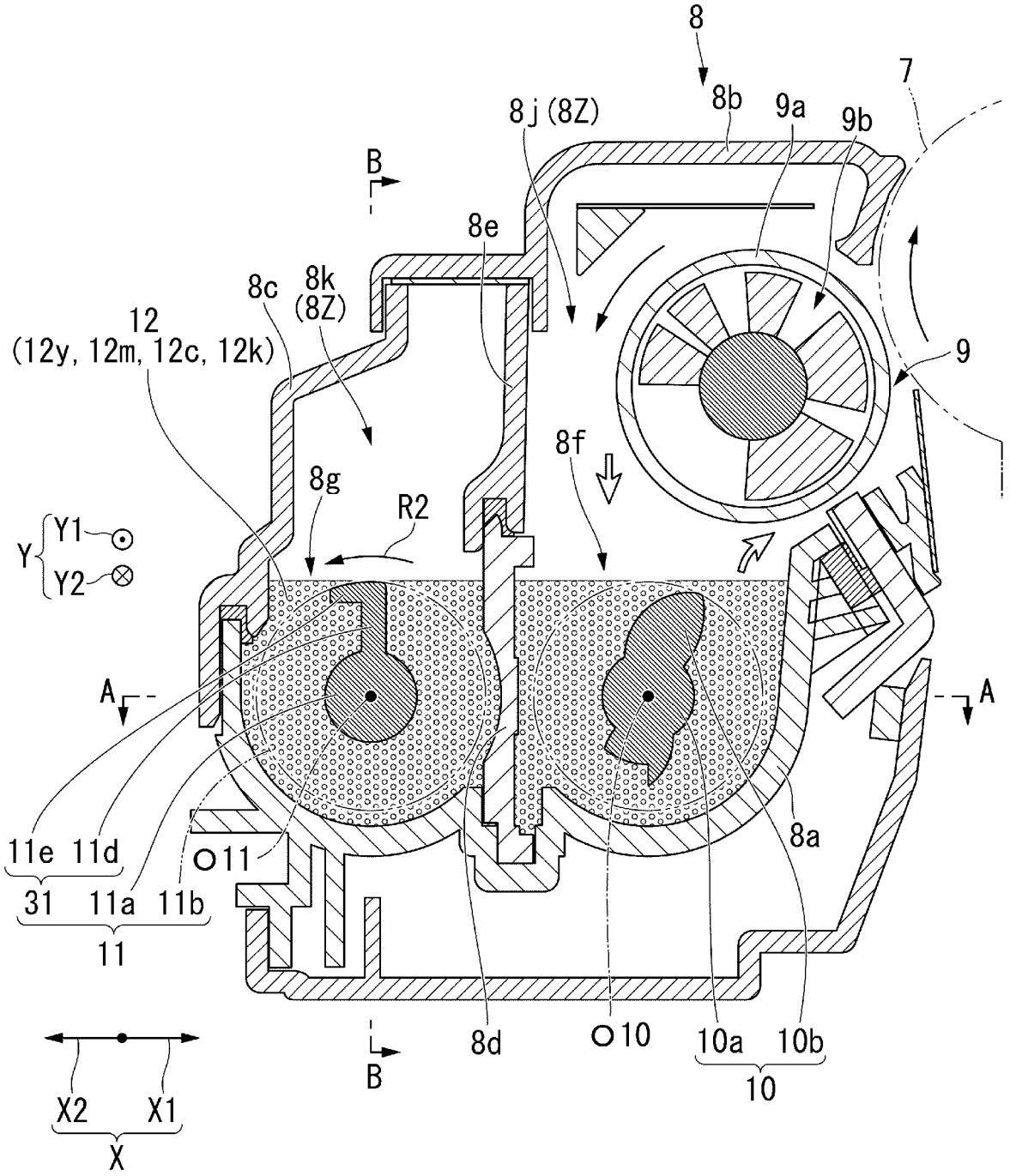
FIG. 2 is a cross-sectional view showing an example of a principal portion of a developing device of an embodiment.
Figure 3:
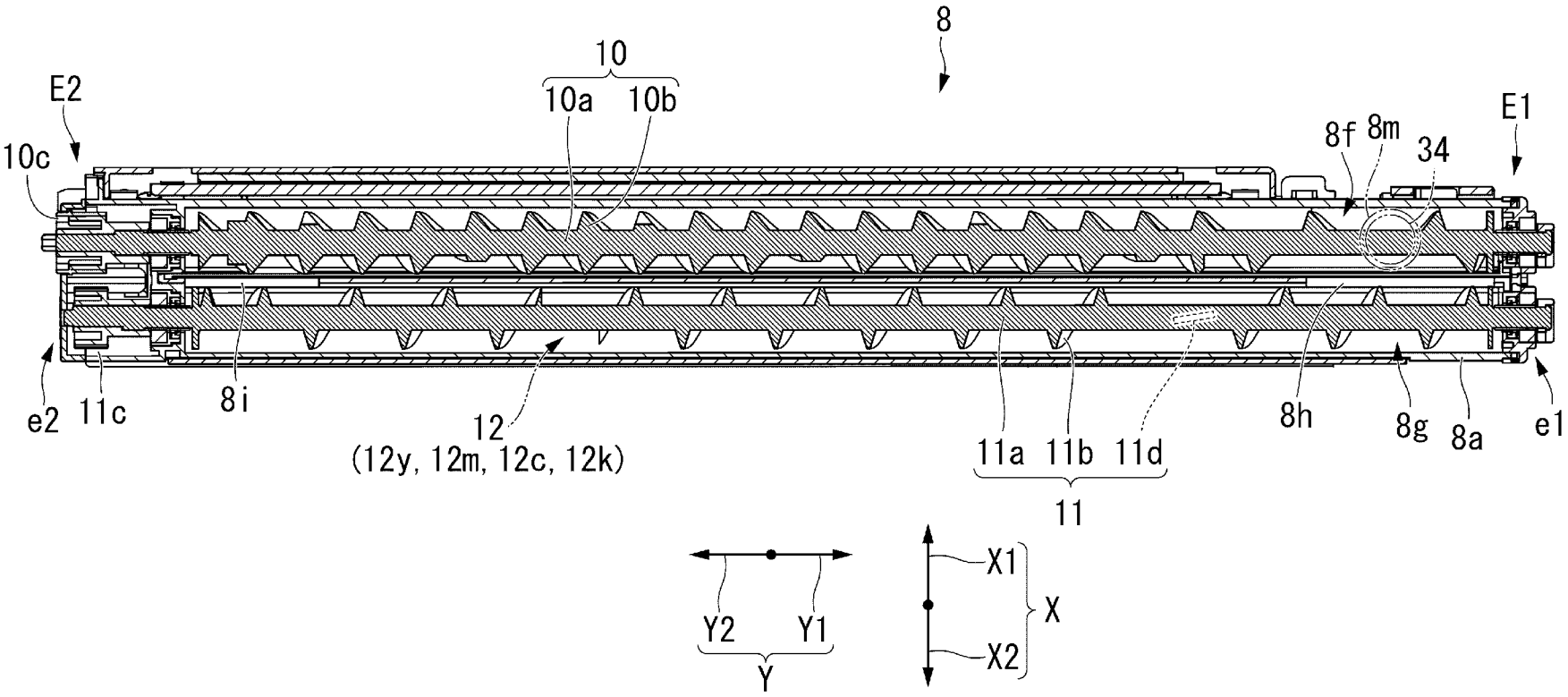
FIG. 3 is an A-A cross-sectional view in FIG. 2.
Figure 4:
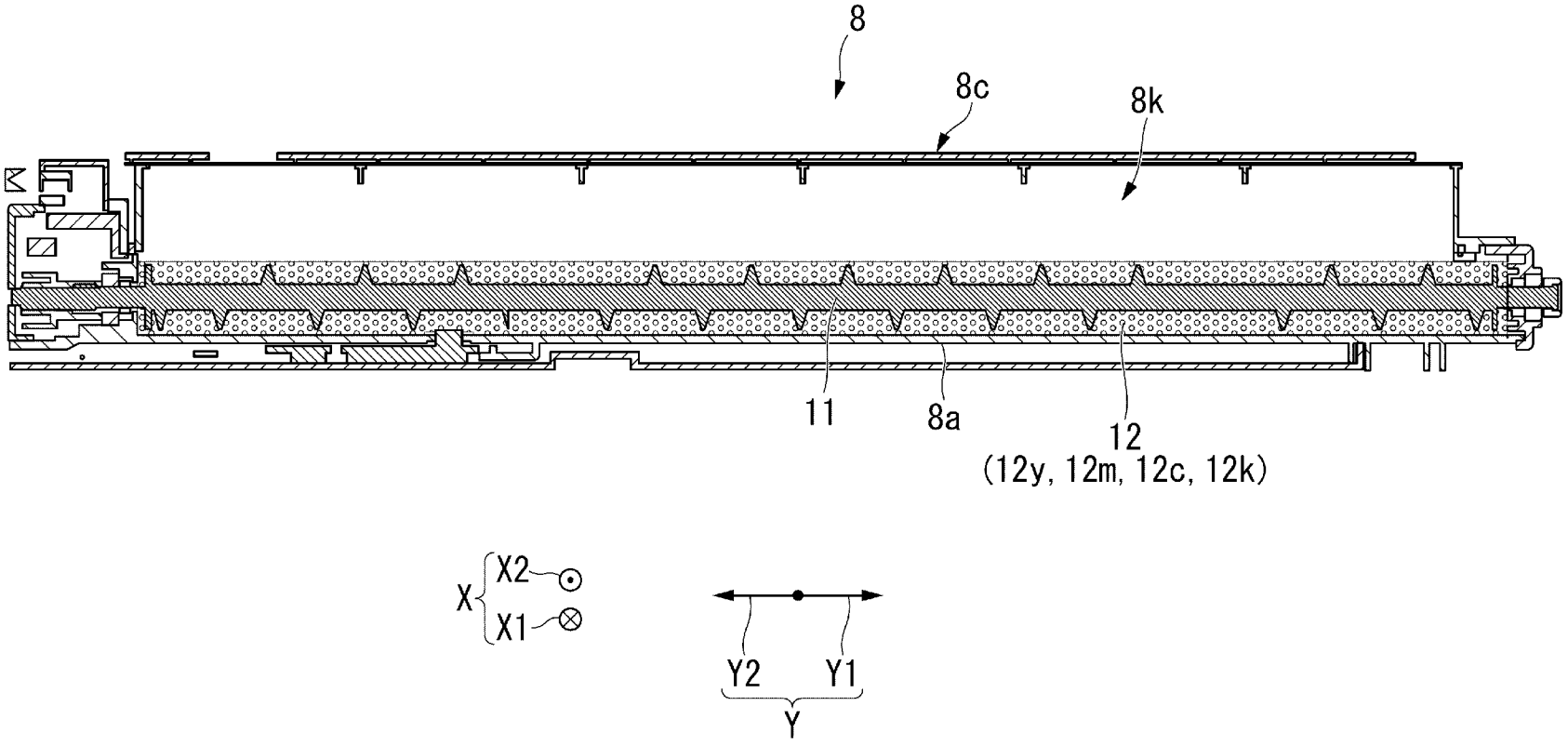
FIG. 4 is a B-B cross-sectional view in FIG. 2.
Figure 5:
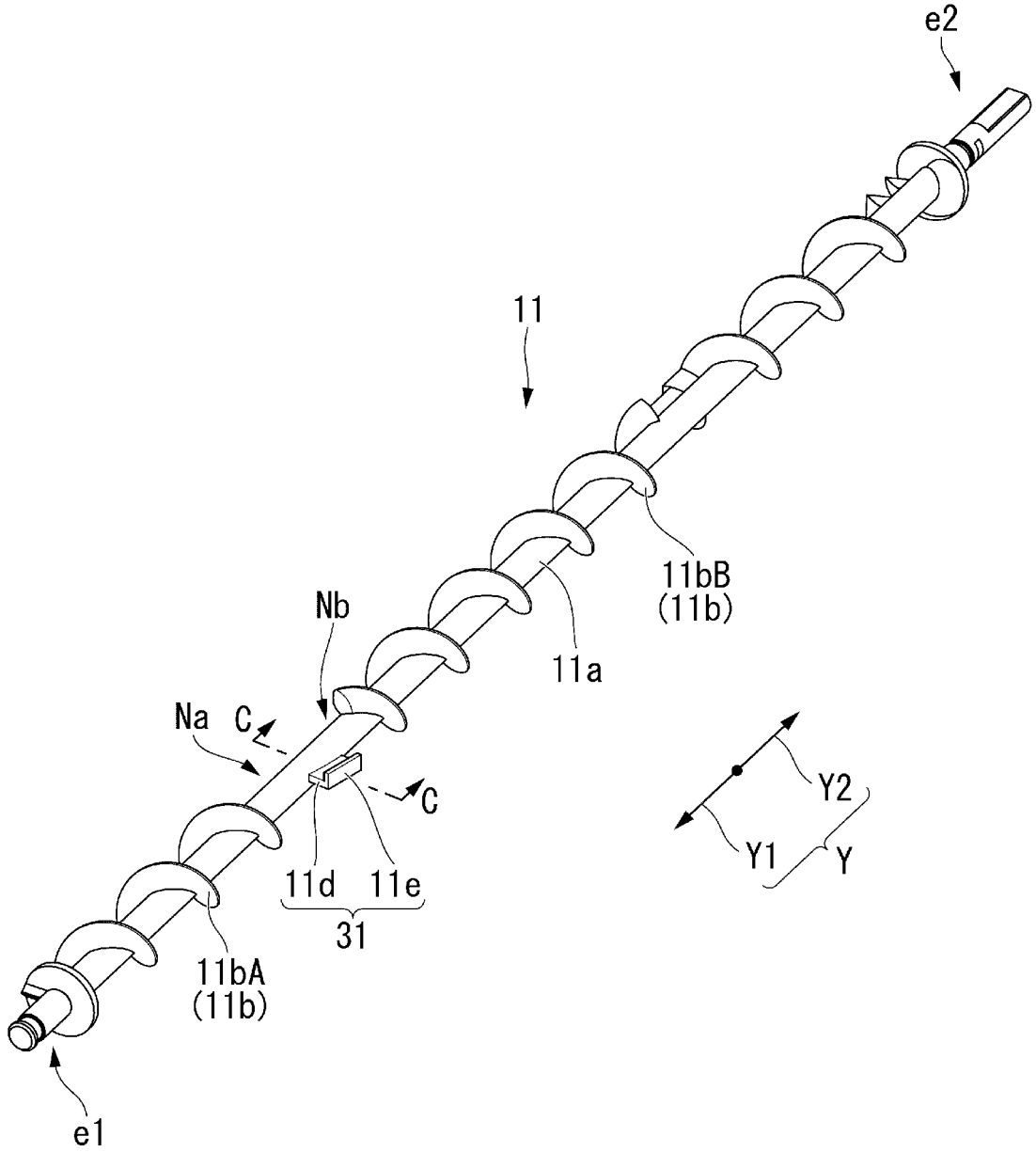
FIG. 5 is a schematic perspective view showing an example of a second stirring screw of the developing device of the embodiment.
Figure 6:
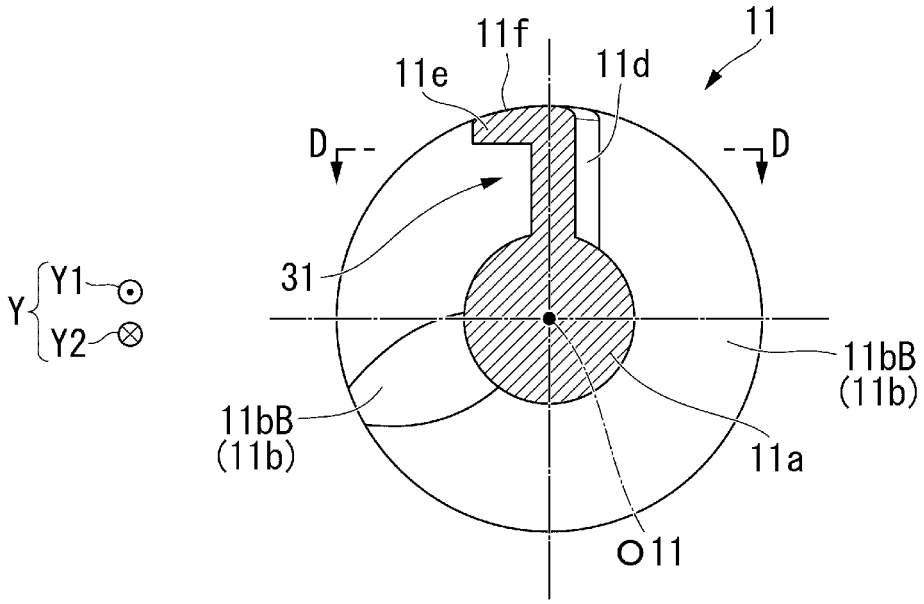
FIG. 6 is a C-C cross-sectional view in FIG. 5.
Figure 7:
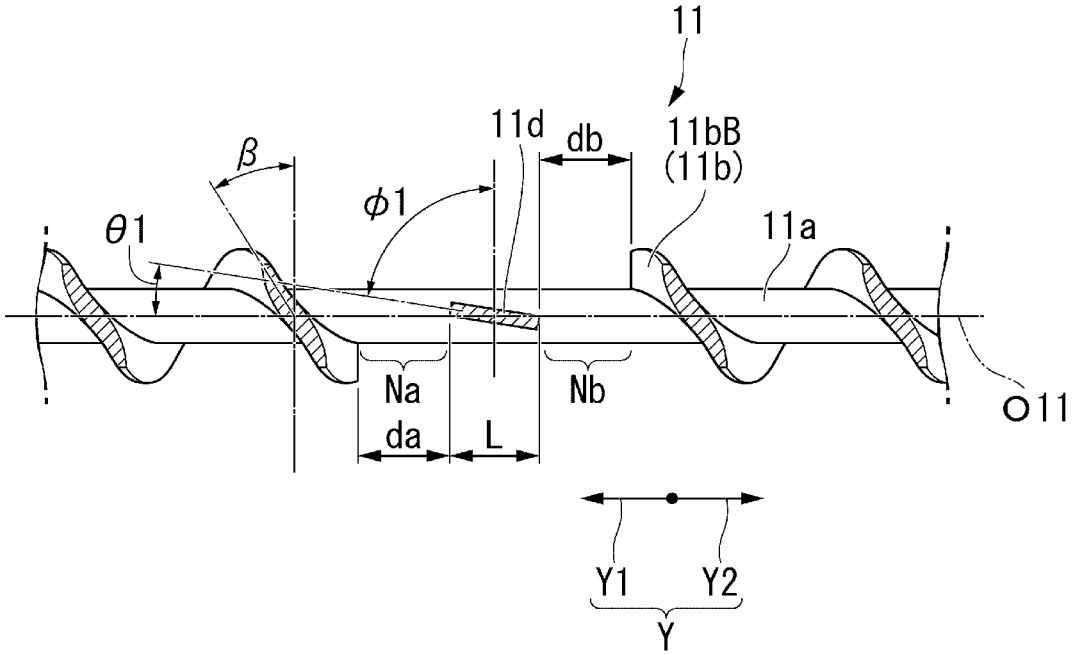
FIG. 7 is a D-D cross-sectional view in FIG. 5.

FIG. 2 is a cross-sectional view showing an example of a principal portion of the developing device of the embodiment. FIG. 3 is an A-A cross-sectional view in FIG. 2. FIG. 4 is a B-B cross-sectional view in FIG. 2. FIG. 5 is a schematic perspective view showing an example of a second stirring screw of the developing device of the embodiment. FIG. 6 is a C-C cross-sectional view in FIG. 5. FIG. 7 is a D-D cross-sectional view in FIG. 5.

The developing device 8 performs development by a two-component development system.

As shown in FIG. 2, the developing device 8 includes a developer storage container 8*a*, a magnet roller 9, an upper cover 8*b*, a left cover 8*c*, a first stirring screw 10, and a second stirring screw 11.

The developer storage container 8*a* is a container which is long in the Y direction (longitudinal direction). The developer storage container 8*a* opens upward. The developer storage container 8*a* stores, for example, a developer 12*y*, 12*m*, 12*c*, or 12*k*.

The developer 12*y* (12*m*, 12*c*, or 12*k*) is a mixture of a carrier composed of magnetic fine particles and a yellow (magenta, cyan, or black) toner. When the developer 12*y* (12*m*, 12*c*, or 12*k*) is stirred, the toner is triboelectrically charged. The toner is adhered to the surface of the carrier.

In the following description, when the color of the toner does not particularly need to be distinguished, any of the developers 12*y*, 12*m*, 12*c*, and 12*k* is denoted by "developer 12" for simplicity.

A first partition 8*d* is provided in a central portion in the X direction of the developer storage container 8*a*.

The first partition 8*d* divides a space in the developer storage container 8*a* into two parts in the X direction. According to this, groove portions 8*f* and 8*g* are lined up in this order in the X2 direction inside the developer storage container 8*a*. The cross section in the X direction of each of the groove portions 8*f* and 8*g* has a U-shaped form.

As shown in FIG. 3, the developer storage container 8*a* extends in the Y direction from a first end portion E1 to a second end portion E2 of the developing device 8. Here, the first end portion E1 is an end portion in the Y1 direction in the developing device 8. The second end portion E2 is an end portion in the Y2 direction in the developing device 8. However, in FIG. 3, for ease of viewing, illustration of the developer 12 is omitted.

Each of the first partition 8*d* and the groove portions 8*f* and 8*g* extends in the Y direction.

A first notch portion 8*h* (a first opening portion or an inflow portion of a toner) is formed in an end portion in the Y1 direction of the first partition 8*d*. The first notch portion 8*h* allows the groove portions 8*f* and 8*g* to communicate with each other. The developer 12*y* (12*m*, 12*c*, or 12*k*) in the groove portion 8*f* can move to the groove portion 8*g* through the first notch portion 8*h*.

A second notch portion 8*i* (a second opening portion) is formed in an end portion in the Y2 direction of the first partition 8*d*. The second notch portion 8*i* allows the groove portions 8*f* and 8*g* to communicate with each other. The developer 12*y* (12*m*, 12*c*, or 12*k*) in the groove portion 8*g* can move to the groove portion 8*f* through the second notch portion 8*i*.

As shown in FIG. 2, the magnet roller 9, the upper cover 8*b*, and the left cover 8*c* are disposed above the developer storage container 8*a*. The magnet roller 9, the upper cover 8*b*, and the left cover 8*c* are opposed to the opening on the upper side of the developer storage container 8*a* from above.

The magnet roller 9 supplies the developer 12 to the surface of the photoconductive drum 7. Further, the magnet roller 9 develops the electrostatic latent image on the surface of the photoconductive drum 7. The magnet roller 9 includes a cylindrical developing sleeve 9*a* and a magnet 9*b* disposed inside the developing sleeve 9*a*. The magnet 9*b* is provided with a magnetic field distribution for performing drawing-up, napping, and nap-cutting of the developer 12.

The magnet roller 9 has a wider developing width than the electrostatic latent image forming width of the photoconductive drum 7. The roller width of the magnet roller 9 is shorter than that of the developer storage container 8*a*.

The magnet roller 9 is disposed above the opening of the groove portion 8*f*. The surface of the developing sleeve 9*a* and the surface of the photoconductive drum 7 are in proximity to each other.

The magnet roller 9 is rotationally driven counterclockwise in the drawing by a developing motor (not shown). The magnet roller 9 is rotated by the developing motor so as to obtain a developing linear speed to be determined according to the linear speed of the photoconductive drum 7.

The upper cover 8*b* covers the surface of the magnet roller 9 excluding a portion coming close to the photoconductive drum 7 from above the groove portions 8*f* and 8*g*.

The left cover 8*c* covers a portion which is not covered with the upper cover 8*b* in the X2 direction and the Y direction above the developer storage container 8*a* and the groove portion 8*g*.

Between the upper cover 8*b* and the first partition 8*d*, a second partition 8*e* is disposed over substantially the same length as that of the first partition 8*d*.

The second partition 8*e* divides an internal space located above the developer storage container 8*a* and the first partition 8*d* and below the upper cover 8*b* and the left cover 8*c* into two parts in the X direction. Although an illustration is omitted, the second partition 8*e* closes the opening on the upper side of the first notch portion 8*h* and the second notch portion 8*i*.

In the developing device 8, the developer storage container 8*a*, the upper cover 8*b*, the left cover 8*c*, the first partition 8*d*, and the second partition 8*e* constitute a developer storage unit 8Z.

The developer storage unit 8Z has an internal space surrounded by the developer storage container 8*a*, the upper cover 8*b*, and the left cover 8*c*. The internal space is divided into two parts in the X direction by the first partition 8*d* and the second partition 8*e*. The developer storage unit 8Z is composed of a first storage chamber 8*j* including the groove portion 8*f* and a second storage chamber 8*k* including the groove portion 8*g*. The first storage chamber 8*j* and the second storage chamber 8*k* are lined up in this order in the X2 direction.

The first storage chamber 8*j* has a length capable of storing at least the magnet roller 9 in the Y direction.

The first storage chamber 8*j* is used for circulating the developer 12 between the groove portion 8*f* and the magnet roller 9. When the developer 12 is drawn up from the groove portion 8*f* by the magnet roller 9 (see an upward white arrow in the drawing), the developer 12 moves counterclockwise in the drawing with the rotation of the magnet roller 9. The developer 12 after completion of development moves to an upper part of the first storage chamber 8*j* with the rotation of the magnet roller 9. When the magnet roller 9 rotates so as to be opposed to the second partition 8*e*, the magnetic attraction of the developer 12 to the magnet roller 9 is released. The developer 12 drops on the groove portion 8*f* in the first storage chamber 8*j* by the own weight (see a downward white arrow in the drawing).

In this manner, in the first storage chamber 8*j*, the developer 12 circulates in the vertical direction. The first storage chamber 8*j* is separated from the second storage chamber 8*k* by the second partition 8*e*, and therefore, the developer 12 in the first storage chamber 8*j* is prevented from scattering to the second storage chamber 8*k*.

As shown in FIG. 4, the second storage chamber 8*k* has a larger volume than the entire volume of the developer 12 stored in the developer storage container 8*a*. In an upper part of the groove portion 8*g* in the second storage chamber 8*k*, in an initial state of the developing device 8, an unused developer 12 is stored. The unused developer 12 is introduced into the developer storage container 8*a* by removing a seal (not shown) before starting to use the developing device 8.

As shown by a two-dot chain line in FIG. 3, a toner supply port 8*m* (toner supply unit) is opened above the groove portion 8*f* near to the first end portion E1. The toner supply port 8*m* is provided on the groove portion 8*f* at a position opposed in the X direction to a central position of the first notch portion 8*h* in the Y direction.

To the toner supply port 8*m*, a toner supply tube 34 shown by a two-dot chain line can be connected. Further, the toner supply port 8*m* is provided with a shutter (not shown). The shutter opens when the toner supply tube 34 is connected. The shutter closes when the developing device 8 is detached from the image forming apparatus 100.

When the toner supply tube 34 is connected to the toner supply port 8*m*, the toner conveyed through the toner supply tube 34 is supplied to the developing device 8 through the toner supply port 8*m*. Through the toner supply port 8*m*, the conveyed toner is supplied onto the groove portion 8*f*.

For example, the toner supply tube 34 is connected to the toner cartridge 33Y (33M, 33C, or 33K) shown in FIG. 1. Through this toner supply tube 34, the toner of the same color as the toner contained in the developer 12*y* (12*m*, 12*c*, or 12*k*) is supplied to the developer 12*y* (12*m*, 12*c*, or 12*k*).

The toner supplied from the toner supply tube 34 drops on the groove portion 8*f* at a position opposed in the X direction to a central position of the first notch portion 8*h* in the Y direction. The toner after dropping on the groove portion 8*f* flows in the groove portion 8*g* from the groove portion 8*f* along with the developer 12 through the first notch portion 8*h*.

The toner supply amount is controlled by controlling the act of the toner conveying mechanism by the body control unit 6. For example, when the output of a toner density sensor (not shown) provided in the developing device 8 decreases, the body control unit 6 drives the toner conveying mechanism so as to compensate for the decreased amount.

As shown in FIG. 2, the first stirring screw 10 and the second stirring screw 11 are disposed inside the groove portions 8*f* and 8*g* of the developer storage container 8*a*, respectively.

As shown in FIG. 3, each of the first stirring screw 10 and the second stirring screw 11 extends in the Y direction.

The first stirring screw 10 is disposed parallel to the magnet roller 9. The first stirring screw 10 conveys the developer 12 in the groove portion 8*f* in the Y1 direction (first direction).

The first stirring screw 10 includes a rotating shaft 10*a* and a screw 10*b*. The rotating shaft 10*a* extends straight in the Y direction. Both end portions of the rotating shaft 10*a* are supported rotatably by bearing portions provided in the developer storage container 8*a*. The rotating shaft 10*a* can rotate around the central axis line O10 of the rotating shaft 10*a*.

A gear 10*c* is provided in an end portion in the Y2 direction of the rotating shaft 10*a*.

The gear 10*c* is connected to a motor (not shown) through a transmission mechanism (not shown). The motor that drives the first stirring screw 10 may be a developing motor or a motor other than a developing motor. In this embodiment, as one example, the first stirring screw 10 is driven by a developing motor. The rotational speed of the first stirring screw 10 has a certain relationship determined according to a transmission gear ratio of the transmission mechanism with respect to the developing linear speed.

The screw 10*b* is formed in a spiral shape on an outer circumferential portion of the rotating shaft 10*a*. The shape of the screw 10*b* is not particularly limited as long as the developer 12 in the groove portion 8*f* can be conveyed in the Y1 direction according to the rotating direction of the rotating shaft 10*a*. For example, in this embodiment, the screw 10*b* is a double threaded spiral screw.

In the first stirring screw 10, the rotating shaft 10*a* and the screw 10*b* may be formed of the same material or different materials. For example, in this embodiment, the rotating shaft 10*a* and the screw 10*b* are integrally formed by resin molding.

The second stirring screw 11 is adjacent to the first stirring screw 10 in the X2 direction with the first partition 8*d* interposed therebetween. The second stirring screw 11 is disposed parallel to the first stirring screw 10. Therefore, the second stirring screw 11 is disposed parallel to the magnet roller 9 at a position farther apart from the magnet roller 9 than the first stirring screw 10.

The second stirring screw 11 conveys the developer 12 in the groove portion 8*g* in the Y2 direction (second direction).

As shown in FIG. 2, the second stirring screw 11 includes a rotating shaft 11*a*, a screw 11*b*, and a paddle member 31.

As shown in FIG. 3, the rotating shaft 11*a* extends straight in the Y direction. A first end portion e1 and a second end portion e2 of the rotating shaft 11*a* are supported rotatably by bearing portions provided in the developer storage container 8*a*. Here, the first end portion e1 is an end portion in the Y1 direction of the rotating shaft 11*a*. The second end portion e2 is an end portion in the Y2 direction of the rotating shaft 11*a*.

The rotating shaft 11*a* can rotate around the central axis line O11 (see FIG. 2) of the rotating shaft 11*a*.

A gear 11*c* is provided in the second end portion e2 of the rotating shaft 11*a*.

The gear 11*c* is connected to a motor (not shown) through a transmission mechanism (not shown).

The motor that drives the second stirring screw 11 may be a developing motor or a motor other than a developing motor. In this embodiment, as one example, the second stirring screw 11 is driven by a developing motor. The rotational speed of the second stirring screw 11 has a certain relationship determined according to a transmission gear ratio of the transmission mechanism with respect to the developing linear speed.

As shown in FIG. 5, the screw 11*b* is formed in a spiral shape on an outer circumferential portion of the rotating shaft 11*a*. In this embodiment, the screw 11*b* is composed of a first screw 11*b*A and a second screw 11*b*B.

The first screw 11*b*A is provided near to the Y1 direction side with respect to the below-mentioned paddle member 31. An end portion in the Y1 direction of the first screw 11*b*A is formed nearer to the Y2 direction side than the first end portion e1 of the rotating shaft 11*a*.

The second screw 11*b*B is provided near to the Y2 direction side with respect to the below-mentioned paddle member 31. An end portion in the Y2 direction of the second screw 11*b*B is formed nearer to the Y1 direction side than the second end portion e2 of the rotating shaft 11*a*.

The first screw 11*b*A and the second screw 11*b*B are disposed spaced apart from each other in the Y direction.

The shapes of the first screw 11*b*A and the second screw 11*b*B are not particularly limited as long as the developer 12 in the groove portion 8*g* can be conveyed in the Y2 direction according to the rotating direction of the rotating shaft 11*a*. For example, in this embodiment, the first screw 11*b*A and the second screw 11*b*B are single threaded spiral screws in which the turning pitches and the turning directions are equal to each other.

The screw 11*b* is a continuous single threaded spiral screw as a whole except that a portion in the Y direction is missing.

In this embodiment, the second stirring screw 11 is rotated counterclockwise in FIG. 2 (left-handed when seen in the Y2 direction, see the arrow R2 in FIG. 2). Therefore, the turning direction of the screw 11*b* is a right-hand direction.

The paddle member 31 includes a paddle 11*d* and a protrusion 11*e*.

The paddle 11*d* is provided for stirring the developer 12 by rotating along with the rotating shaft 11*a*.

As shown in FIG. 3, the paddle 11*d* is provided on the downstream side of the inflow portion of the toner from the groove portion 8*f* to the groove portion 8*g* in the conveying direction of the developer 12 in the developer storage container 8*a*. In this embodiment, the inflow portion of the toner corresponds to the first notch portion 8*h*.

As shown in FIG. 5, the paddle 11*d* protrudes to a lateral side from the outer circumferential face of the rotating shaft 11*a* between the first screw 11*b*A and the second screw 11*b*B.

As shown in FIG. 6, the shape of the paddle 11*d* is a plate shape protruding in a direction intersecting with the central axis line O11 at an acute angle. The paddle 11*d* may be a flat plate or a curved plate in a spiral shape.

The height in the protruding direction of the paddle 11*d* is equal to the outer diameter of the screw 11*b*. The thickness of the paddle 11*d* may change in at least one of the protruding direction and the longitudinal direction.

As shown in FIG. 7, when seen in the radial direction of the rotating shaft 11*a*, the paddle 11*d* is inclined with respect to the central axis line O11 at an angle θ1 (provided that $\theta 1<90°$). For example, when the paddle 11*d* is a spirally curved plate with a lead angle ϕ1, θ1 is represented by $90°-\phi 1$.

Here, the magnitude of θ1 and an inclination direction are determined according to the stirring performance and the conveying performance for the developer 12 required for the paddle 11*d* as described later.

The length L along the central axis line O11 of the paddle 11*d* is also determined according to the stirring performance and the conveying performance for the developer 12 required for the paddle 11*d* as described later.

In this embodiment, the both end portions in the length direction of the paddle 11*d* are separated from the first screw 11*b*A and the second screw 11*b*B at distances of da and db, respectively. In an on-axis area Na having a width da between the first screw 11*b*A and the paddle 11*d* and an on-axis area Nb having a width db between the second screw 11*b*B and the paddle 11*d*, a protrusion is not formed on the rotating shaft 11*a*. Therefore, in the on-axis areas Na and Nb, even if the second stirring screw 11 rotates, a stirring force and a conveying force are hardly applied to the developer 12.

The separation distances da and db are not particularly limited. However, when the separation distances become too large, a problem may occur in the conveyance of the developer 12.

In the example shown in FIG. 7, as one example, the paddle 11*d* is composed of a flat plate. In this case, the paddle 11*d* is inclined with respect to the central axis line O11 in the same direction as the screw 11*b*. That is, when seen in the Y2 direction, the paddle 11*d* is inclined to the right side as proceeding in the Y2 direction. $\phi 1$ satisfies $\phi 1<\beta$.

As shown in FIG. 6, the protrusion 11*e* protrudes counterclockwise in the drawing from a tip portion in the protruding direction of the paddle 11*d*. The protruding direction of the protrusion 11*e* coincides with the rotating direction of the second stirring screw 11. The protrusion amount of the protrusion 11*e* is constant in the length direction of the paddle 11*d*.

The upper face 11*f* of the protrusion 11*e* is curved along the contour of the screw 11*b* when seen in the Y2 direction.

The paddle 11*d* and the protrusion 11*e* form a protrusion portion having a key-shaped (reverse L-shaped) cross section orthogonal to the central axis line O11.

In the second stirring screw 11, the rotating shaft 11*a*, the screw 11*b*, the paddle 11*d*, and the protrusion 11*e* may be formed of the same material or different materials. For example, in this embodiment, the rotating shaft 11*a*, the screw 11*b*, the paddle 11*d*, and the protrusion 11*e* are integrally formed by resin molding.

Next, an act of the image forming apparatus 100 will be described while focusing on an action of the developing device 8.

First, an act of image formation of the image forming apparatus 100 will be briefly described.

In the image forming apparatus 100 shown in FIG. 1, image formation is started by an operation of the control panel 1 or an external signal. Image information is sent to the printer unit 3 by reading an object to be copied by the scanner unit 2 or is externally sent to the printer unit 3.

The printer unit 3 feeds the sheet S from the sheet feed unit 4 to the resist roller 24. The sheet S to be fed from the sheet feed unit 4 is selected by the body control unit 6 based on an operation of the control panel 1 or an external signal.

When an operation input for image formation is performed from the control panel 1, the body control unit 6 performs control for starting paper feed from a paper feed cassette and image formation.

The image forming units 25Y, 25M, 25C, and 25K form electrostatic latent images on the respective photoconductive drums 7 based on the image information according to the respective colors. The respective electrostatic latent images are developed by the developing devices 8, respectively. Therefore, toner images corresponding to the electrostatic latent images are formed on the surfaces of the respective photoconductive drums 7.

The respective toner images are primarily transferred to the intermediate transfer belt 27 by the respective transfer rollers. At this time, the transfer timing is appropriately shifted according to the arrangement positions of the image forming units 25Y, 25M, 25C, and 25K. Therefore, the respective toner images are sequentially overlapped with one another with the movement of the intermediate transfer belt 27 without causing a color shift and sent to the transfer unit 28.

On the other hand, the sheet S is fed and sent from the resist roller 24 to the transfer unit 28. The toner images after reaching the transfer unit 28 are secondarily transferred to the sheet S. The secondarily transferred toner images are fixed to the sheet S by the fixing device 29.

On the intermediate transfer belt 27, a transfer residual toner remains. The transfer residual toner is a toner which cannot be transferred onto the sheet S by the transfer unit 28. The transfer residual toner is scraped off by the transfer belt cleaning unit 35. The intermediate transfer belt 27 is cleaned so as to be made reusable.

Next, an act of the developing device 8 will be described while focusing on an act of stirring the developer 12.

Figure 8:
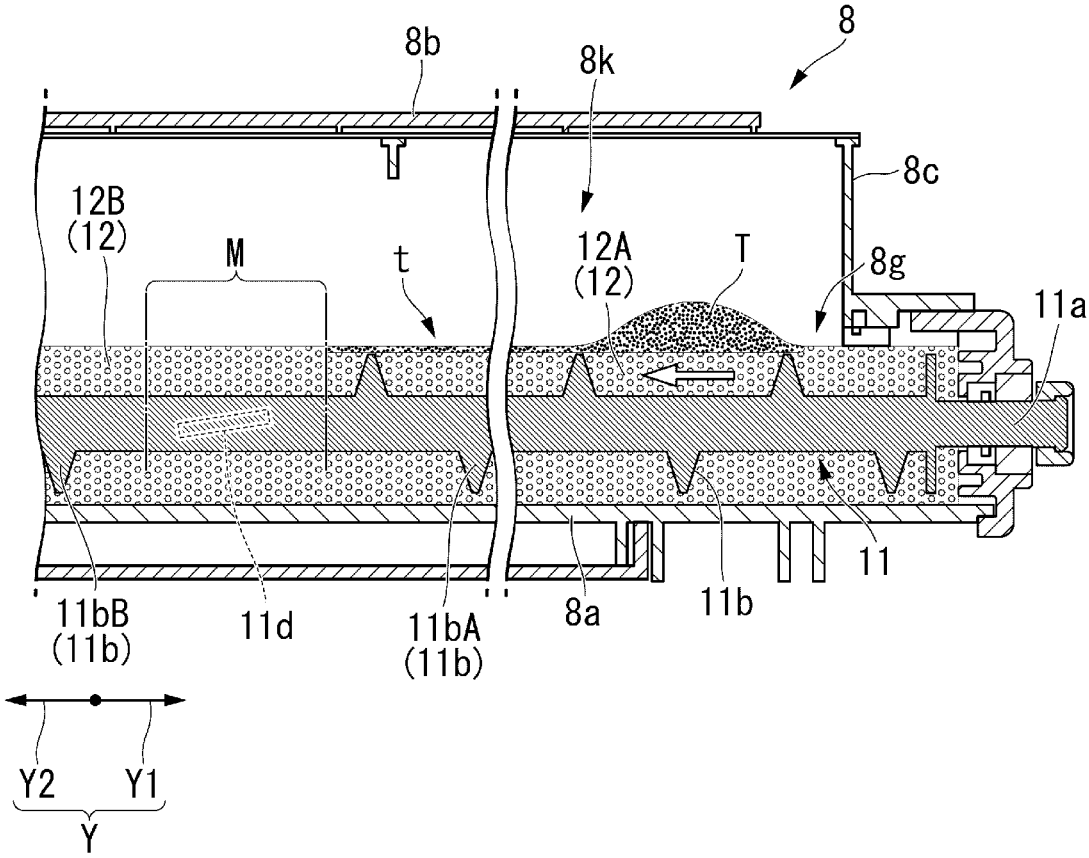
FIG. 8 is a schematic cross-sectional view illustrating an act of the developing device of the embodiment.

FIG. 8 is a schematic cross-sectional view illustrating an act of the developing device of the embodiment.

While performing image formation by the image forming apparatus 100, in the developing device 8, the first stirring screw 10 and the second stirring screw 11 are rotated by a motor.

The first stirring screw 10 conveys the developer 12 in the groove portion 8*f* in the Y1 direction while stirring the developer 12. The developer 12 in the groove portion 8*f* is conveyed from the second notch portion 8*i* to the first notch portion 8*h*.

The second stirring screw 11 conveys the developer 12 in the groove portion 8*g* in the Y2 direction while stirring the developer 12. The developer 12 in the groove portion 8*g* is conveyed from the first notch portion 8*h* to the second notch portion 8*i*.

The conveyance amounts of the first stirring screw 10 and the second stirring screw 11 are equal to each other. Therefore, the developer 12 after reaching the first notch portion 8*h* moves to the groove portion 8*g* through the first notch portion 8*h*. The developer 12 after reaching the second notch portion 8*i* moves to the groove portion 8*f* through the second notch portion 8*i*. In this manner, the developer 12 is circulated and conveyed in the developer storage container 8*a*.

As a result, a substantially uniform flow occurs in the developer 12 in the groove portion 8*f* opposed to the magnet roller 9. To the developer 12 that moves to the groove portion 8*f*, the uniformly charged toner is adhered by the rotation of the second stirring screw 11.

As shown in FIG. 2, the developer 12 in the vicinity of the magnet roller 9 is drawn up on the developing sleeve 9*a* by the magnetic force of the magnet 9*b*. The developer 12 adsorbed on the surface of the developing sleeve 9*a* rotates along with the developing sleeve 9*a*. The developer 12 forms a magnetic brush at a position opposed to the photoconductive drum 7 according to the magnetic force distribution of the magnet 9*b*.

When a developing bias is applied to the toner in the magnetic brush by the body control unit 6, the toner is electrostatically adsorbed on the electrostatic latent image on the photoconductive drum 7. According to this, the electrostatic latent image on the photoconductive drum 7 is developed with the toner.

The developer 12 in which part of the toner is lost moves in the first storage chamber 8*j* with the rotation of the developing sleeve 9*a* and drops on the groove portion 8*f* from the developing sleeve 9*a* according to the magnetic force distribution of the magnet 9*b*.

When image formation proceeds, the developer 12 in which the toner is reduced is mixed in the developer 12 conveyed by the first stirring screw 10. The developers 12 having different toner adhesion amounts are moved in the Y1 direction and also stirred by the first stirring screw 10.

In this manner, when image formation is started, the toner density of the developer 12 in the groove portion 8*f* decreases.

The body control unit 6 monitors the toner density by the toner density sensor (not shown). The body control unit 6 controls toner supply as needed. According to this, the toner is supplied from the toner cartridge through the toner supply tube 34 and the toner supply port 8*m*.

The supplied toner moves from the groove portion 8*f* to the end portion in the Y1 direction of the groove portion 8*g* along with the developer 12 that moves to the groove portion 8*f* through the first notch portion 8*h*.

In FIG. 8, a state where a supplied toner T is moved on the groove portion 8*g* is shown.

Here, an act of the second stirring screw 11 in the groove portion 8*g* will be described in detail.

Figure 9:
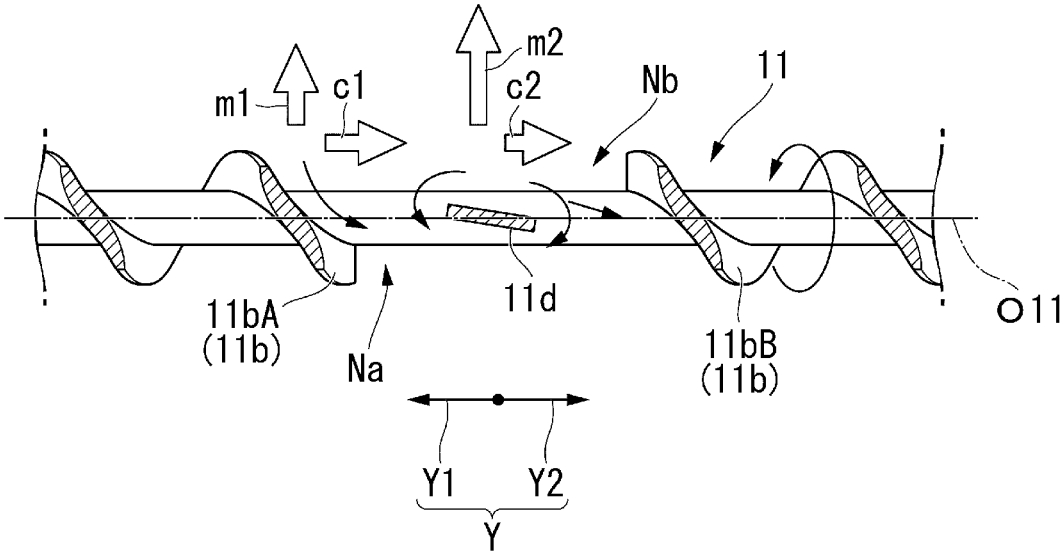
FIG. 9 is a schematic view showing a flow of the developer along the second stirring screw.

FIG. 9 is a schematic view showing a flow of the developer along the second stirring screw.

As shown in FIG. 5, in the second stirring screw 11, the first screw 11*b*A, the on-axis area Na, the paddle member 31, the on-axis area Nb, and the second screw 11*b*B are formed in the Y2 direction.

In this embodiment, the first screw 11*b*A and the second screw 11*b*B have the same conveying performance and the same stirring performance. For example, as shown in FIG. 9, the screw 11*b* has a stirring force m1 in the circumferential direction and a conveying force c1 in the axial direction according to a lead angle of the screw 11*b*.

The on-axis areas Na and Nb have little conveying performance and stirring performance.

The paddle 11*d* of the paddle member 31 has conveying performance according to an angle θ1 and stirring performance according to the length L along the central axis line O11. For example, when the angle φ1 satisfies $\phi 1<\beta$, as shown in FIG. 9, the paddle 11*d* has a stirring force m2 (provided that m2>m1) in the circumferential direction and a conveying force c2 (provided that c2<c1) in the axial direction according to an inclination angle with respect to the central axis line O11.

With the rotation of the second stirring screw 11, the developer 12 (not shown in FIG. 9) is pushed out to the on-axis area Na from the first screw 11*b*A and is temporarily retained there. The developer 12 passes through the on-axis area Na by continuously pushing out the developer 12 from the first screw 11*b*A.

The paddle 11*d* pushes out the developer 12 at a low speed strongly in the circumferential direction by the stirring force m2. Part of the developer 12 is conveyed in the Y2 direction by the conveying force c2 from the paddle 11*d*. The developer 12 retained around the paddle 11*d* as a whole goes around to the rear face of the paddle 11*d* and meets the developer 12 pushed out from the first screw 11*b*A.

In this manner, in a space around the paddle 11*d*, complicated flows of the developers 12 having different speeds and different moving directions are formed. The developer 12 as a whole gradually passes through the on-axis area Nb and moves to a region where the conveying force of the second screw 11*b*B acts.

In this manner, with the movement of the paddle 11*d*, the developer 12 is remarkably stirred around the paddle 11*d*.

Next, an action of the protrusion 11*e* of the paddle member 31 will be described.

As shown in FIG. 8, the toner T drops on an upper part of the developer 12 conveyed in the Y2 direction by the second stirring screw 11. The toner T is lighter than the developer 12 containing a carrier, and therefore moves in the Y2 direction along with the developer 12 in a surface layer. As the conveyance proceeds, part of the toner T is mixed with the developer 12 along with the developer 12 to be stirred. However, the developer 12 is also stored above the second stirring screw 11, and therefore, the developer 12 is conveyed in a state where a toner layer t is deposited in a certain amount on an upper part of the developer 12.

However, in this embodiment, mixing and stirring of the toner T and the developer 12 are promoted by the protrusion 11*e*.

Figure 10:
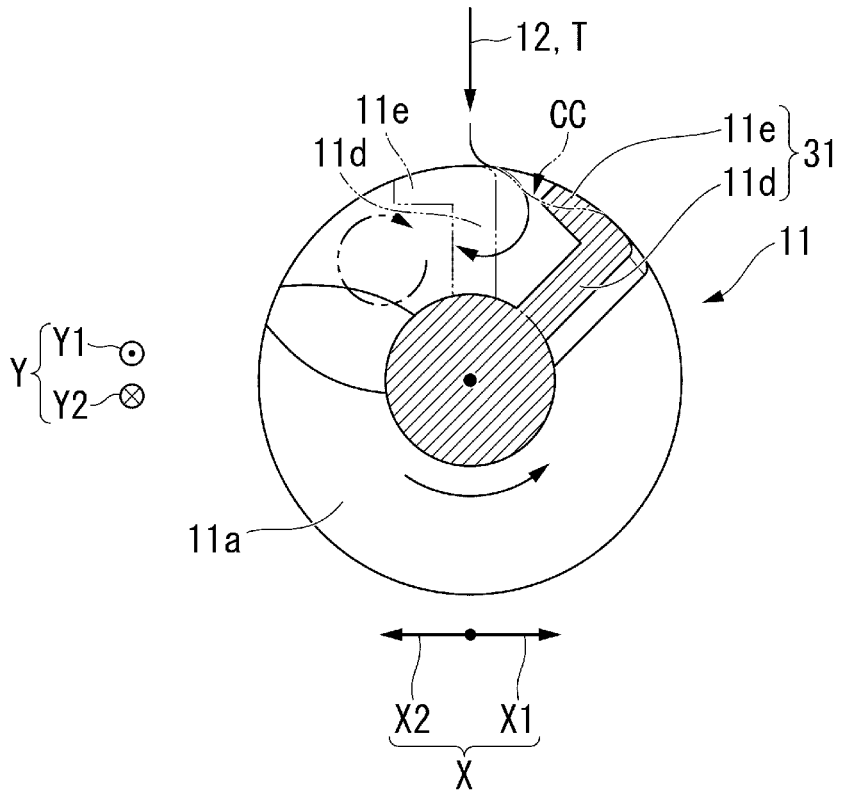
FIG. 10 is a schematic view showing a flow of the toner along a paddle and a protrusion.
Figure 11:
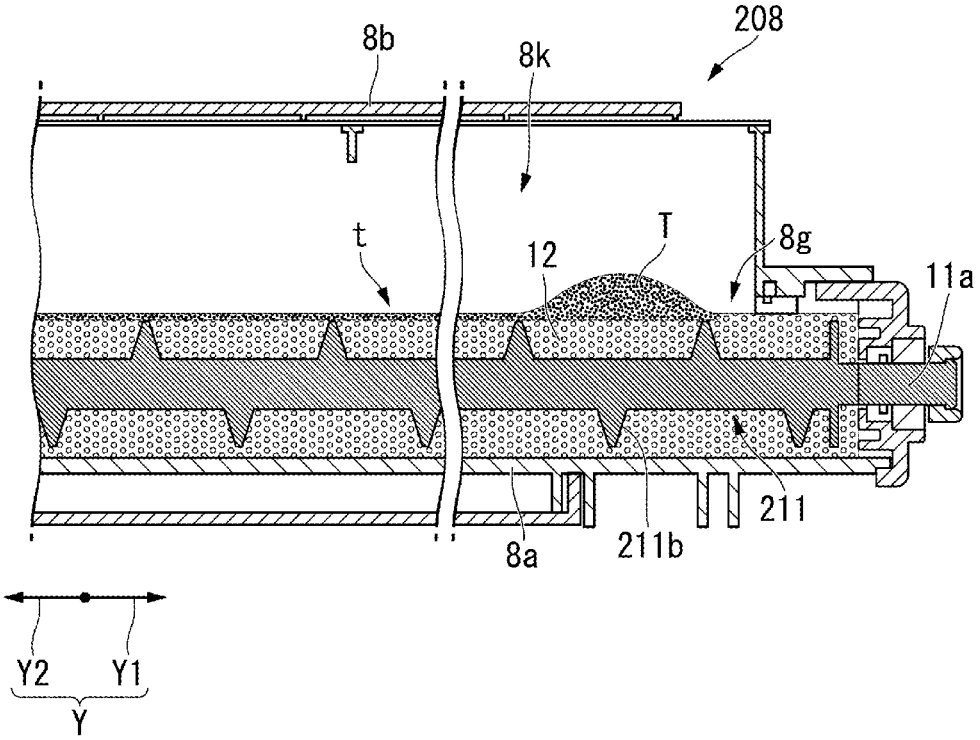
FIG. 11 is a schematic cross-sectional view illustrating an act of a developing device of Comparative Example.

FIG. 10 is a schematic view showing a flow of the toner along the paddle and the protrusion. FIG. 11 is a schematic cross-sectional view illustrating an act of a developing device of Comparative Example.

As shown in FIG. 10, the developer 12 and the toner T after moving above the second stirring screw 11 are scraped off below (on the rotating shaft 10*a* side) the protrusion 11*e* and pushed in toward the rotating shaft 10*a*. As shown by a two-dot chain line in FIG. 10, by further rotating the paddle member 31, the developer 12 and the toner T are pressed in the rotating direction by the paddle 11*d*. Therefore, the developer 12 and the toner T are swirled up and down and stirred nearer to the rotating direction side than the paddle 11*d*.

On the other hand, on the back face side of the paddle 11*d* in the rotating direction, the developer 12 is reduced and a recessed portion CC is formed. Therefore, the developer 12 and the toner T sink in the recessed portion CC, and stirring of the developer 12 and the toner T is further promoted.

As described above, mixing and stirring of the developer 12 and the toner T are promoted particularly around the paddle member 31.

As a result, as shown in FIG. 8, even if the toner T and a developer 12A are remarkably separated in the inflow portion of the toner T, when the developer 12A reaches a stirring promoting space M including the paddle member 31 (not shown), the toner layer t is mixed and stirred with the developer 12A, and a developer 12B in a state where the toner T is uniformly dispersed in the developer 12A is formed. The toner T is adsorbed on the carrier of the developer 12 by triboelectric charging during stirring.

The developer 12B is further conveyed in the Y2 direction while being stirred by the second screw 11*b*B.

A developing device 208 of Comparative Example shown in FIG. 11 includes a second stirring screw 211 in place of the second stirring screw 11 of the developing device 8. The second stirring screw 211 is configured to delete the paddle member 31 from the second stirring screw 11 and include a continuous single threaded screw 211*b* in place of the screw 11*b*.

In this case, substantially uniform stirring performance and conveying performance are obtained throughout the Y direction by the second stirring screw 211. Therefore, the length in the Y direction of the toner layer t deposited in an upper part of the developer 12 is remarkably prolonged as compared with this embodiment. The toner T in the toner layer t is not stirred by the second stirring screw 211, and therefore, charging failure may occur.

As described above, in this embodiment, the second stirring screw 11 includes the paddle member 31 (the paddle 11*d* and the protrusion 11*e*), and therefore, the developer 12B in which the supplied toner T is uniformly dispersed is conveyed in the Y2 direction. The developer 12B moves from the groove portion 8*g* to the groove portion 8*f* when reaching the second notch portion 8*i*. As described above, the developer 12B is conveyed by the first stirring screw 10 and used for development in the groove portion 8*f*.

As described above, according to the image forming apparatus 100 and the developing device 8 of this embodiment, since the second stirring screw 11 is included, the stirring performance for the developer 12 is improved. In particular, the toner T supplied to the developing device 8 can be efficiently stirred, and therefore, an image quality when supplying the toner becomes more stable.

According to at least one embodiment described above, the developing device and the image forming apparatus capable of improving the stirring performance for the developer can be provided.

Hereinafter, modifications of the above-mentioned embodiments will be described with reference to the drawings.

First Modification

A developing device of a first modification will be described.

Figure 12:
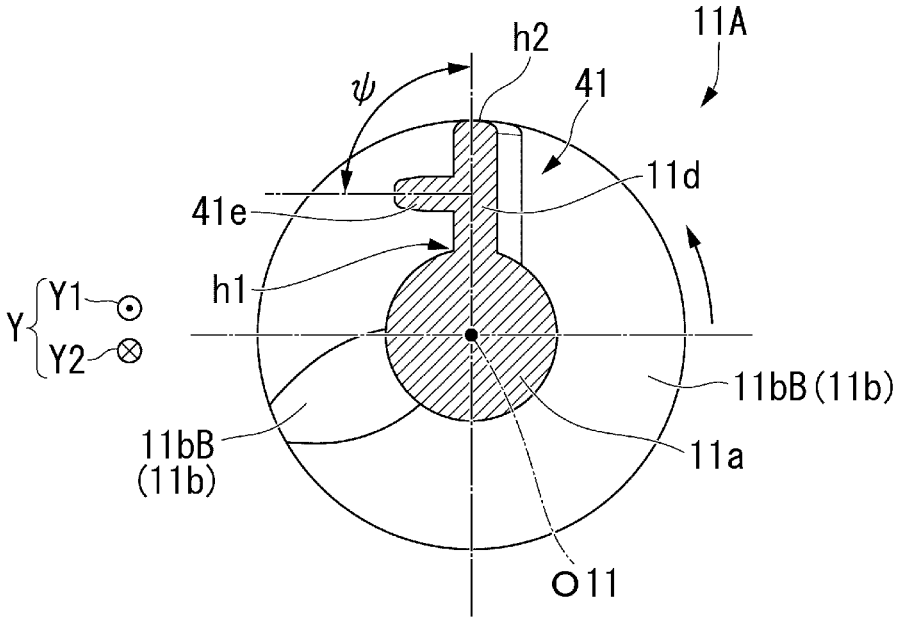
FIG. 12 is a schematic cross-sectional view showing an example of a second stirring screw of a first modification of the embodiment.

FIG. 12 is a schematic cross-sectional view showing an example of a second stirring screw of the first modification of the embodiment.

A developing device 8A of the first modification shown in FIG. 1 includes a second stirring screw 11A (see FIG. 12) in place of the second stirring screw 11 of the developing device 8 of the embodiment.

As shown in FIG. 12, the second stirring screw 11A includes a paddle member 41 in place of the paddle member 31 of the second stirring screw 11. The paddle member 41 includes a protrusion 41*e* in place of the protrusion 11*e* of the paddle member 31 of the embodiment.

The developing device 8A can be used in the image forming apparatus 100 in place of the developing device 8.

Hereinafter, different points from the embodiment will be mainly described.

The protrusion 41*e* protrudes counterclockwise in the drawing between a proximal end portion h1 and a distal end portion h2 in the protruding direction (height direction) of the paddle 11*d*. Here, the proximal end portion h1 is a connection portion between the paddle 11*d* and the rotating shaft 11*a*.

In the example shown in FIG. 12, the protruding direction of the protrusion 41*e* coincides with the rotating direction of the second stirring screw 11A. However, the protruding direction of the protrusion 41*e* may be shifted from the rotating direction. For example, when an angle formed by the protruding direction of the protrusion 41*e* and the protruding direction of the paddle 11*d* is represented by ψ, ψ may be smaller than 90°.

The protrusion amount of the protrusion 41*e* may be constant or may vary in the length direction of the paddle 11*d*. For example, a tip portion in the protruding direction of the protrusion 41*e* may be in a wavy form or the like.

The shape of the cross section orthogonal to the central axis line O11 of the protrusion 41*e* may be a rectangular shape or may be a tapered shape in which the thickness decreases in the protruding direction.

According to the developing device 8A, the second stirring screw 11A includes the paddle 11*d* and the protrusion 41*e*, and therefore, the stirring performance for the developer 12 is improved as compared with the embodiment.

In particular, the protrusion 41*e* is formed in a middle portion in the height direction of the paddle 11*d*. Therefore, the protrusion 41*e* can efficiently stir the developer 12 particularly in a region on the inner side of the outer circumference of the screw 11*b*.

Second Modification

A developing device of a second modification will be described.

Figure 13:
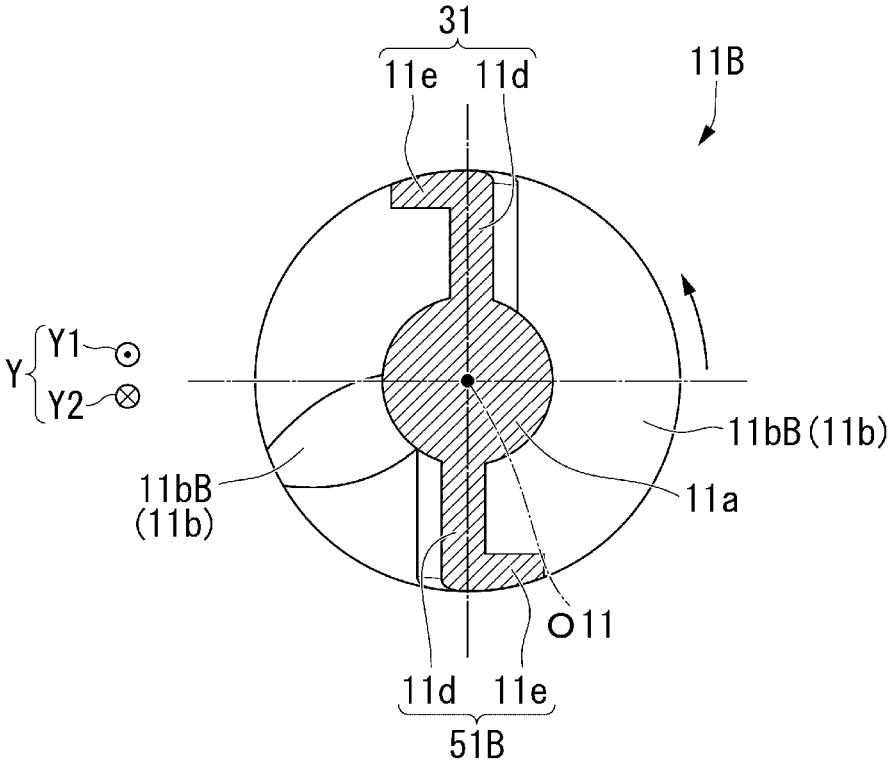
FIG. 13 is a schematic cross-sectional view showing an example of a second stirring screw of a second modification of the embodiment.

FIG. 13 is a schematic cross-sectional view showing an example of a second stirring screw of the second modification of the embodiment.

A developing device 8B of the second modification shown in FIG. 1 includes a second stirring screw 11B (see FIG. 13) in place of the second stirring screw 11 of the developing device 8 of the embodiment.

As shown in FIG. 13, the second stirring screw 11B is the same as the second stirring screw 11 of the embodiment except that a paddle member 51B is added.

The developing device 8B can be used in the image forming apparatus 100 in place of the developing device 8.

Hereinafter, different points from the embodiment will be mainly described.

The paddle member 51B is composed of the paddle 11*d* and the protrusion 11*e* in the same manner as the paddle member 31. For example, the paddle member 51B has a position and a shape that are rotationally symmetrical by 180° to the paddle member 31 with respect to the central axis line O11. However, the arrangement positions in the Y direction of the paddle members 31 and 51B may be shifted from each other.

This modification is an example of a case where a plurality of paddle members are included in the circumferential direction, while the second stirring screw 11 in the embodiment is an example of including one paddle member 31 in the circumferential direction. However, the number of paddle members is not limited to 2. For example, three or more paddle members may be provided in the circumferential direction on an outer circumferential portion of the rotating shaft 11*a*. When three or more paddle members are provided, the arrangement pitch of the paddle members is more preferably a pitch equally dividing the circumference.

Further, the plurality of paddle members may have the same shape or different shapes.

According to the developing device 8B, the second stirring screw 11B includes the paddle members 31 and 51B, and therefore, the stirring performance for the developer 12 is improved as compared with the embodiment.

In particular, by including the paddle members 31 and 51B, the stirring performance per rotation is enhanced and doubled as compared with the embodiment.

Third Modification

A developing device of a third modification will be described.

Figure 14:
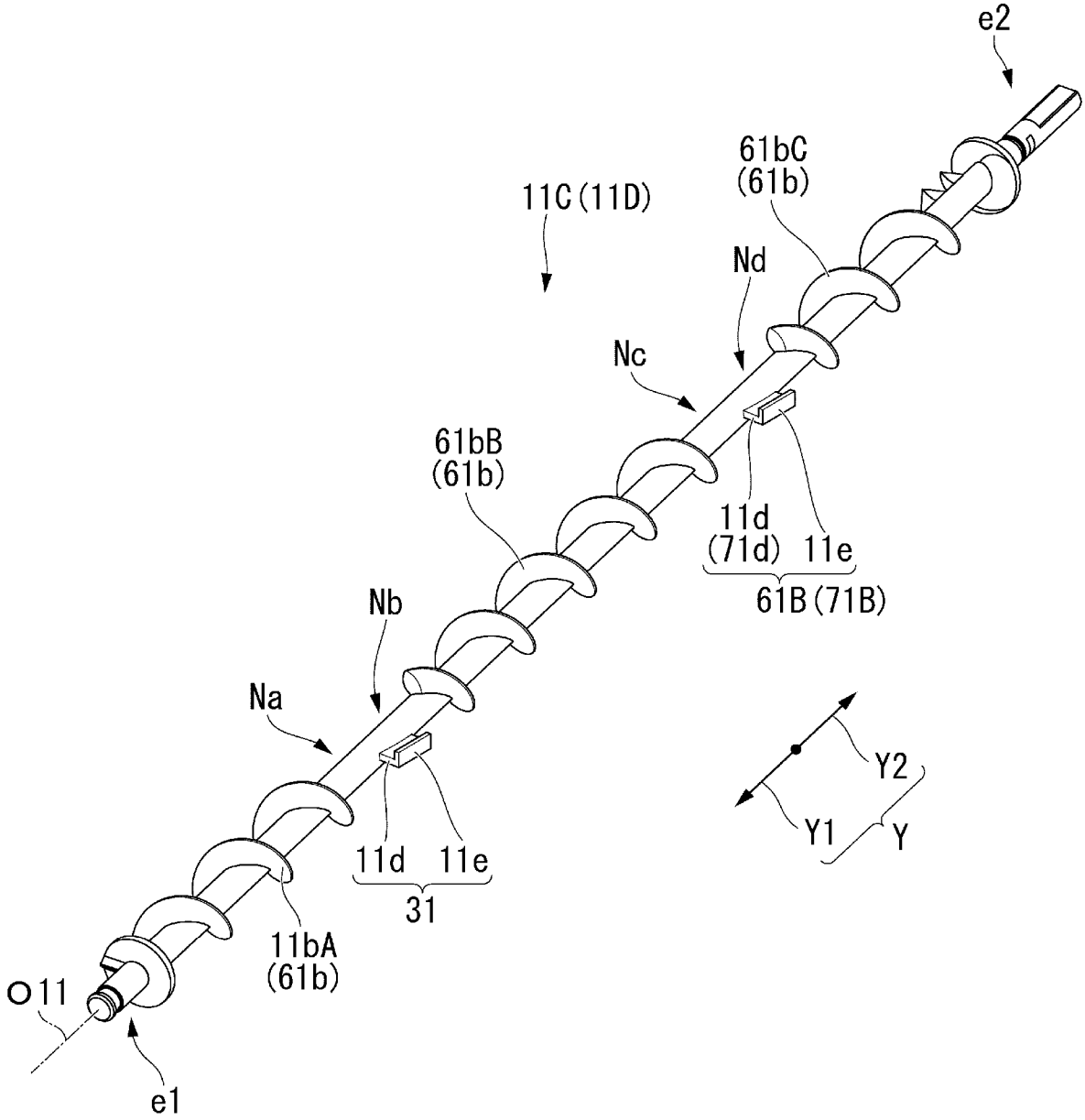
FIG. 14 is a schematic perspective view showing an example of a second stirring screw of a third modification of the embodiment.

FIG. 14 is a schematic perspective view showing an example of a second stirring screw of the third modification of the embodiment.

A developing device 8C of the third modification shown in FIG. 1 includes a second stirring screw 11C (see FIG. 14) in place of the second stirring screw 11 of the developing device 8 of the embodiment.

As shown in FIG. 14, the second stirring screw 11C includes a screw 61*b* in place of the screw 11*b* in the embodiment. Further, the second stirring screw 11C includes the same paddle member 31 as in the embodiment and a paddle member 61B.

The developing device 8C can be used in the image forming apparatus 100 in place of the developing device 8.

Hereinafter, different points from the embodiment will be mainly described.

The paddle member 61B is composed of the paddle 11*d* and the protrusion 11*e* in the same manner as the paddle member 31. For example, the paddle member 61B has a position and a shape such that the paddle member 31 is moved parallel to the Y2 direction. However, the arrangement positions in the circumferential direction of the paddle members 31 and 61B may be shifted from each other. In this case, the paddle member 61B is disposed at a position where the paddle member 31 is moved parallel to the Y2 direction, and thereafter rotationally moved by an appropriate angle around the central axis line O11.

The screw 61*b* includes a second screw 61*b*B and a third screw 61*b*C in place of the second screw 11*b*B of the screw 11 in the embodiment.

The second screw 61*b*B and the third screw 61*b*C are formed in the same manner as the second screw 11*b*B except that an appropriate length is notched with a position where the paddle member 61B is formed as the center.

In the example shown in FIG. 14, the second screw 61*b*B is provided near to the Y1 direction side with respect to the paddle member 61B. An end portion in the Y1 direction of the second screw 61*b*B is adjacent to the on-axis area Nb.

The third screw 61*b*C is provided near to the Y2 direction side with respect to the paddle member 61B. An end portion in the Y2 direction of the third screw 61*b*C is formed at the same position as the end portion in the Y2 direction of the second screw 11*b*B in the embodiment.

The second screw 61*b*B and the third screw 61*b*C are disposed spaced apart from each other in the Y direction.

Between the second screw 61*b*B and the paddle member 61B, and between the paddle member 61B and the third screw 61*b*C, on-axis areas Nc and Nd similar to the on-axis areas Na and Nb are formed, respectively.

This modification is an example of a case where a plurality of paddle members having the same shape are included in the Y direction, while the second stirring screw 11 in the embodiment is an example of including one paddle member 31 in the Y direction (axial direction). However, the number of paddle members is not limited to 2. For example, three or more paddle members may be provided in the axial direction of the rotating shaft 11*a*.

According to the developing device 8C, the second stirring screw 11C includes the paddle members 31 and 61B, and therefore, the stirring performance for the developer 12 is improved.

As described in the embodiment, the stirring promoting space M is formed in the vicinity of the paddle member 31. In this modification, a stirring promoting space similar to the stirring promoting space M is also formed in the vicinity of the paddle member 61B in the same manner. Therefore, the stirring performance on the downstream side in the conveying direction (Y2 direction) in the groove portion 8*g* is further improved.

Fourth Modification

A developing device of a fourth modification will be described.

Figure 15:
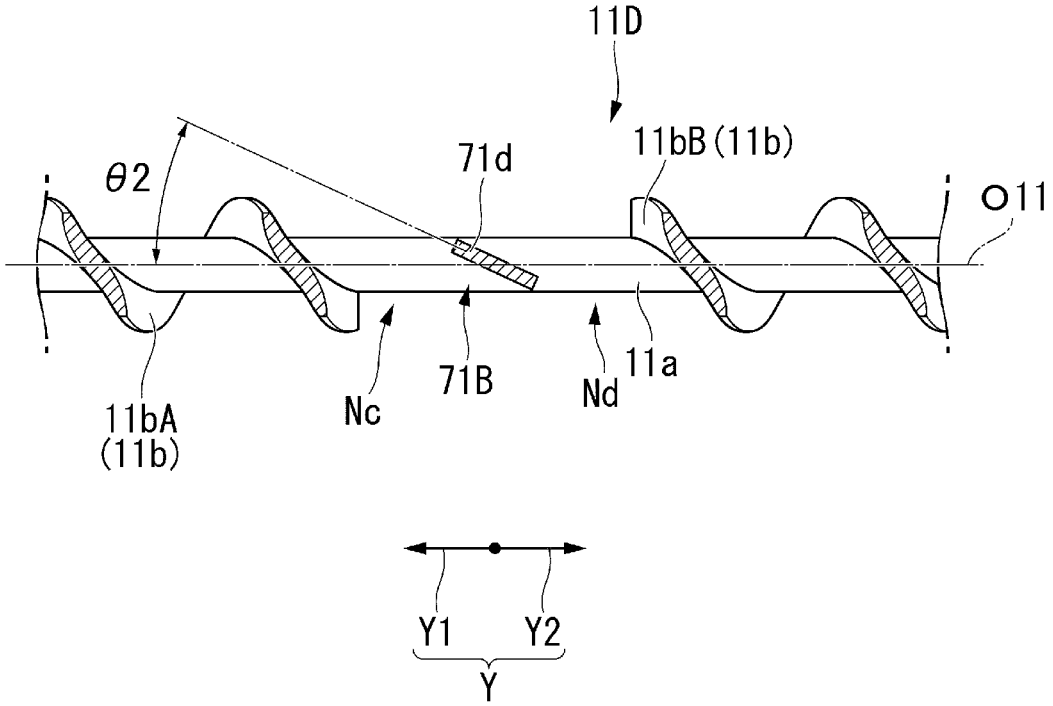
FIG. 15 is a schematic cross-sectional view showing an example of a second stirring screw of a fourth modification of the embodiment.

FIG. 15 is a schematic cross-sectional view showing an example of a second stirring screw of the fourth modification of the embodiment.

A developing device 8D of the fourth modification shown in FIG. 1 includes a second stirring screw 11D (see FIGS. 14 and 15) in place of the second stirring screw 11 of the developing device 8 of the embodiment.

As shown in FIG. 14, the second stirring screw 11D includes a paddle member 71B in place of the paddle member 61B in the third modification.

The developing device 8D can be used in the image forming apparatus 100 in place of the developing device 8.

Hereinafter, different points from the embodiment and the third modification will be mainly described.

The paddle member 71B includes a paddle 71*d* in place of the paddle 11*d* in the paddle member 61B of the third modification.

As shown in FIG. 15, the paddle 71*d* is different from the paddle 11*d* in the inclination angle with respect to the central axis line O11. An angle θ2 formed by the paddle 71*d* and the central axis line O11 is larger than θ1.

Therefore, the paddle 71*d* has further improved conveying performance instead of having lower stirring performance as compared with the paddle 11*d*.

The second stirring screw 11C in the third modification is an example of including a plurality of paddle members having the same stirring performance and conveying performance in the Y direction (axial direction). On the other hand, this modification is an example of a case where the plurality of paddle members provided in the Y direction have different stirring performance and conveying performance. However, in the same manner as in the third modification, the number of paddle members is not limited to 2. For example, three or more paddle members may be provided in the axial direction of the rotating shaft 11*a*.

According to the developing device 8D, the second stirring screw 11D includes the paddle members 31 and 71B, and therefore, the stirring performance for the developer 12 is improved as compared with the embodiment.

In particular, in this modification, the paddle member 71B has higher conveying performance than the paddle member 61B in the third modification. Therefore, the developer 12 can be smoothly moved from the groove portion 8*g* to the groove portion 8*f*. According to this, the supply amount of the developer 12 in the groove portion 8*f* becomes more stable, and therefore, uneven development is further suppressed.

On the other hand, the paddle member 71B has poor stirring performance as compared with the paddle member 61B. However, the developer 12 that moves in the groove portion 8*g* is also subjected to stirring by the second screw 61*b*B until reaching the paddle member 71B. Therefore, even if the stirring performance is low to some extent, a necessary toner charge amount can be ensured.

According to the second stirring screw 11D, the inclination angle of the paddle member 31 on the upstream side in the conveying direction is made small, and the inclination angle of the paddle member 71B on the downstream side in the conveying direction is made large. Therefore, the second stirring screw 11D can reliably stir the developer 12 in an upstream portion. In a downstream portion, the developer 12 stirred to some extent in the upstream portion can be stably conveyed.

Fifth Modification

A developing device of a fifth modification will be described.

Figure 16:
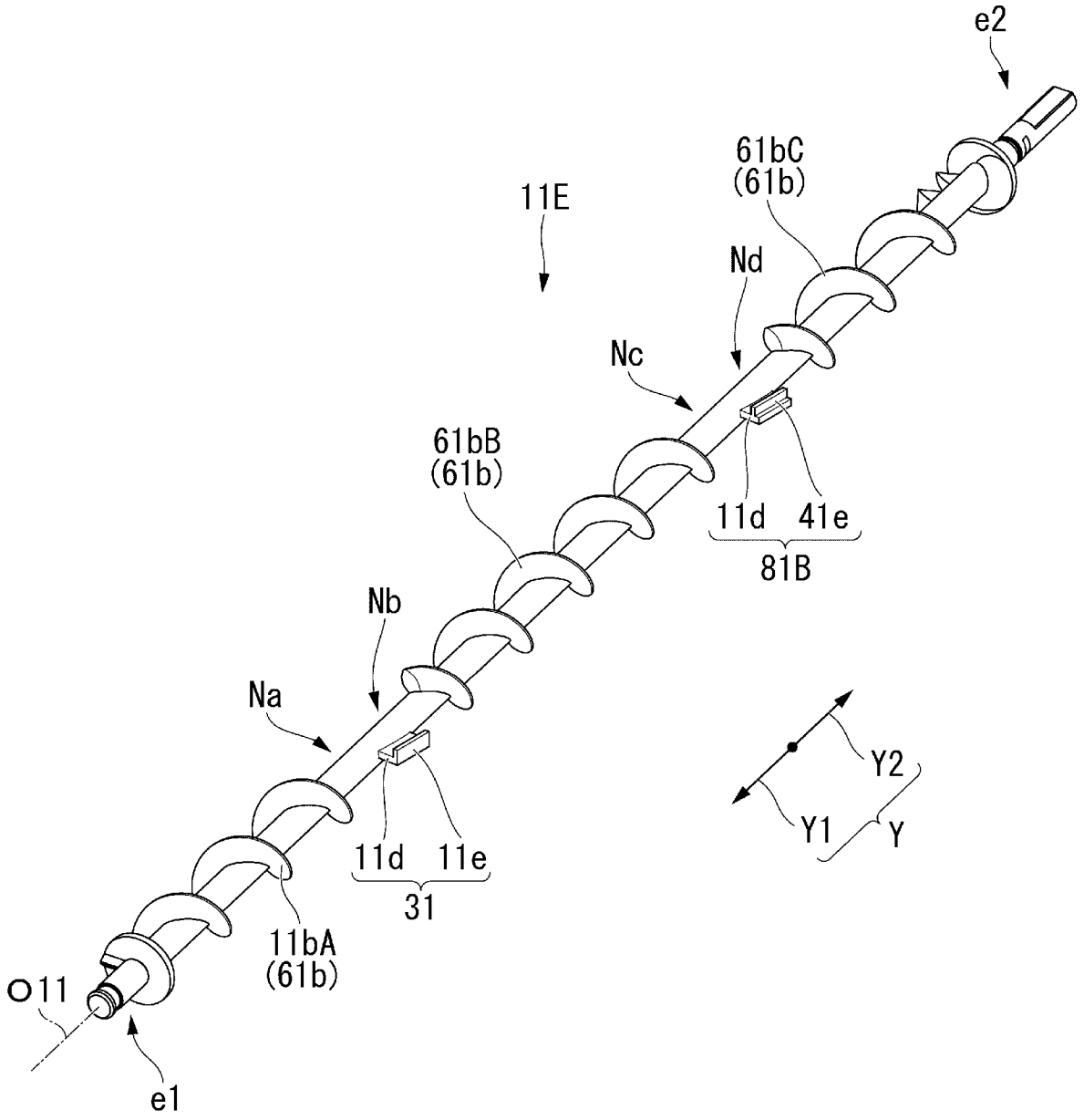
FIG. 16 is a schematic perspective view showing an example of a second stirring screw of a fifth modification of the embodiment.

FIG. 16 is a schematic perspective view showing an example of a second stirring screw of the fifth modification of the embodiment.

A developing device 8E of the fifth modification shown in FIG. 1 includes a second stirring screw 11E (see FIG. 16) in place of the second stirring screw 11C of the developing device 8C of the third modification.

As shown in FIG. 16, the second stirring screw 11E includes a paddle member 81B in place of the paddle member 61B in the third modification.

The developing device 8E can be used in the image forming apparatus 100 in place of the developing device 8.

Hereinafter, different points from the embodiment and the third modification will be mainly described.

The paddle member 81B includes the same protrusion 41*e* as in the first modification in place of the protrusion 11*e* in the paddle member 61B of the third modification.

The circumferential speed of the protrusion 41*e* of the paddle member 81B is lower than the circumferential speed of the protrusion 11*e* of the paddle member 61B. Therefore, the stirring performance due to the contribution of the protrusion 41*e* is lower than the stirring performance due to the contribution of the protrusion 11*e*. As a result, the amount of work by the rotation of the second stirring screw 11E consumed by stirring decreases, and therefore, the conveying performance of the paddle member 81B becomes relatively higher than the conveying performance of the paddle member 61B.

The second stirring screw 11C in the third modification is an example of including a plurality of paddle members having the same stirring performance and conveying performance in the Y direction (axial direction). On the other hand, this modification is an example of a case where the plurality of paddle members provided in the Y direction have different stirring performance and conveying performance in the same manner as in the fourth modification.

However, the method for changing the stirring performance and the conveying performance is different from the fourth modification.

According to the developing device 8E, the second stirring screw 11E includes the paddle members 31 and 81B, and therefore, the stirring performance for the developer 12 is improved as compared with the embodiment.

In particular, in this modification, the paddle member 81B has higher conveying performance than the paddle member 61B in the third modification. Therefore, the developer 12 can be smoothly moved from the groove portion 8*g* to the groove portion 8*f* in the same manner as in the fourth modification. According to this, the supply amount of the developer 12 in the groove portion 8*f* becomes more stable, and therefore, uneven development is further suppressed.

On the other hand, the paddle member 81B has poor stirring performance as compared with the paddle member 61B. However, the developer 12 that moves in the groove portion 8*g* is also subjected to stirring by the second screw 61*b*B until reaching the paddle member 81B. Therefore, even if the stirring performance is low to some extent, a necessary toner charge amount can be ensured.

Further, in this modification, the paddle member 31 and the paddle member 81B are different in the region to be remarkably stirred in the height direction of the paddle 11*d*. Therefore, the uniformity of stirring for the developer 12 is more likely to be improved.

As in the fourth modification and this modification, when a plurality of paddle members are provided in the axial direction, the paddle member near to the Y1 direction side more preferably has high stirring performance, and the paddle member near to the Y2 direction side more preferably has high conveying performance. In the fourth modification, in order to change the stirring performance and the conveying performance, the inclination angle of the paddle with respect to the central axis line O11 is changed. In this modification, the position of the protrusion in the height direction of the paddle is changed.

However, the stirring performance and the conveying performance may be changed by a method other than these. For example, by changing the length of the paddle, the height of the paddle, the cut width of the screw, or the like, necessary stirring performance and conveying performance may be adjusted.

Further, as a method for changing the stirring performance and the conveying performance, a plurality of methods may be combined.

Sixth Modification

A developing device of a sixth modification will be described.

Figure 17:
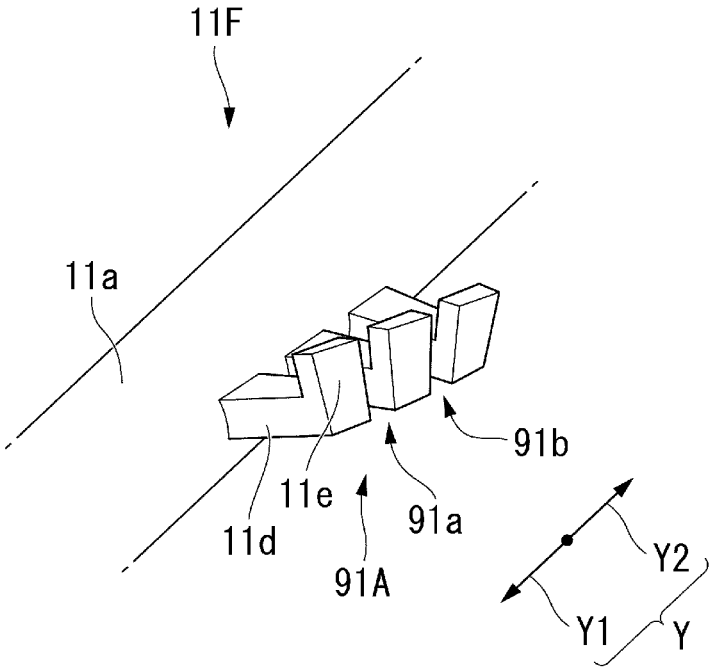
FIG. 17 is a schematic perspective view showing an example of a second stirring screw of a sixth modification of the embodiment.

FIG. 17 is a schematic perspective view showing an example of a second stirring screw of the sixth modification of the embodiment.

A developing device 8F of the sixth modification shown in FIG. 1 includes a second stirring screw 11F (see FIG. 17) in place of the second stirring screw 11 of the developing device 8 of the embodiment.

As shown in FIG. 17, the second stirring screw 11F includes a comb teeth-shaped paddle member 91A in place of the paddle 11*d* and the protrusion 11*e* in the embodiment.

The developing device 8F can be used in the image forming apparatus 100 in place of the developing device 8.

Hereinafter, different points from the embodiment will be mainly described.

The comb teeth-shaped paddle member 91A corresponds to the form in which the paddle member 31 in the embodiment is divided into three by slits 91*a* and 91*b*. However, the number of slits is an example. The number of slits in the comb teeth-shaped paddle member 91A may be one or three or more.

The slits 91*a* and 91*b* penetrate the paddle 11*d* and the protrusion 11*e* in a direction perpendicular to the length direction of the paddle 11*d*. That is, the depth of each of the slits 91*a* and 91*b* is equivalent to the height of the paddle 11*d*. However, the depth of each of the slits 91*a* and 91*b* may be smaller than the height of the paddle 11*d*. The depths of the respective slits 91*a* and 91*b* may be different from each other.

The magnitudes of the widths of the slits 91*a* and 91*b* in the length direction of the paddle 11*d* are not particularly limited as long as the carrier of the developer 12 can pass therethrough. The magnitudes of the widths of the slits 91*a* and 91*b* may be different from each other.

According to the developing device 8F, the second stirring screw 11F includes the comb teeth-shaped paddle member 91A, and therefore, by including the paddle 11*d* and the protrusion 11*e*, the comb teeth-shaped paddle member 91A has the same stirring performance as in the embodiment.

Further, in the comb teeth-shaped paddle member 91A, when the developer 12 passes through the slits 91*a* and 91*b*, the developer 12 is subjected to frictional resistance from the comb teeth-shaped paddle member 91A. Therefore, by subjecting the developer 12 passing through the slits 91*a* and 91*b* to the frictional resistance from the comb teeth-shaped paddle member 91A, stirring and charging of the developer 12 are promoted. Due to this, the stirring performance for the developer 12 is improved as compared with the embodiment.

However, the paddle 11*d* is divided in the length direction, and therefore, the conveying performance of the comb teeth-shaped paddle member 91A is deteriorated as compared with the embodiment.

The stirring performance and the conveying performance of the comb teeth-shaped paddle member 91A can be adjusted by appropriately changing the magnitudes of the widths, the number, and the depths of slits, and so on.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A developing device, comprising:

a developer storage unit including a first storage chamber and a second storage chamber storing a developer and configured to circulate and convey the developer through a first opening portion and a second opening portion formed in both end portions in a longitudinal direction of the first storage chamber and the second storage chamber;

a toner supply unit configured to supply a toner to the developer storage unit;

a magnet roller disposed extending in the longitudinal direction in an upper portion of the first storage chamber, the magnet roller configured to adsorb the developer;

a first stirring screw disposed along the longitudinal direction below the magnet roller inside the first storage chamber and configured to convey the developer from the second opening portion to the first opening portion along the longitudinal direction; and a second stirring screw including a rotating shaft disposed parallel to the first stirring screw inside the second storage chamber, a screw protruding from the rotating shaft to a lateral side configured to convey the developer from the first opening portion to the second opening portion along the longitudinal direction by rotation around the central axis line of the rotating shaft, a paddle protruding from the rotating shaft to a lateral side configured to stir the developer by the rotation, and a protrusion protruding from the paddle in the rotating direction;

wherein the paddle includes a first paddle including a first protrusion protruding in the rotating direction, and a second paddle disposed downstream of the first paddle in a conveying direction of the developer and including a second protrusion protruding in the rotating direction, and the position of the second protrusion in the height direction of the second paddle is lower than the position of the first protrusion in the height direction of the first paddle.

2. The device according to claim 1, wherein the paddle is inclined with respect to the central axis line so as to convey the developer from the first opening portion to the second opening portion.

3. The device according to claim 2, wherein the paddle is inclined with respect to the central axis line at a smaller angle than the screw.

4. The device according to claim 2, wherein the paddle is inclined with respect to the central axis line at an acute angle.

5. The device according to claim 3, wherein the paddle is inclined with respect to the central axis line at an acute angle.

6. The device according to claim 3, wherein the paddle includes a first paddle, and a second paddle disposed downstream of the first paddle in a conveying direction of the developer, and an inclination angle with respect to the central axis line of the second paddle is larger than an inclination angle with respect to the central axis line of the first paddle.

7. The device according to claim 1, wherein the paddle is provided on the downstream side of an inflow portion of the toner where the toner flows on the second stirring screw in the conveying direction of the developer.

8. The device according to claim 1, wherein a plurality of paddles are provided in a circumferential direction of the rotating shaft.

9. The device according to claim 8, wherein the plurality of paddles are provided evenly spaced apart in the circumferential direction of the rotating shaft.

10. The device according to claim 1, wherein a plurality of paddles are provided in an axial direction of the rotating shaft.

11. The device according to claim 10, wherein the plurality of paddles are provided evenly spaced apart in the axial direction of the rotating shaft.

12. The device according to claim 1, wherein a plurality of screws are provided spaced apart in the axial direction, and the paddle is disposed between the screws adjacent to each other in the axial direction separately from each of the screws.

13. The device according to claim 12, wherein the plurality of screws are spaced apart evenly.

14. An image forming apparatus, comprising the developing device according to claim 1.

15. A method of processing a developer in an image forming apparatus, comprising:

circulating and conveying the developer through a first opening portion and a second opening portion formed in both end portions in a longitudinal direction of a first storage chamber and a second storage chamber of a developer storage unit including the first storage chamber and the second storage chamber;

supplying a toner to the developer storage unit; adsorbing the developer using a magnet roller disposed extending in the longitudinal direction in an upper portion of the first storage chamber;

conveying the developer from the second opening portion to the first opening portion along the longitudinal direction using a first stirring screw disposed along the longitudinal direction below the magnet roller inside the first storage chamber; and stirring and conveying the developer from the first opening portion to the second opening portion along the longitudinal direction by rotation around the central axis line of a rotating shaft of a second stirring screw, the second stirring screw including the rotating shaft disposed parallel to the first stirring screw inside the second storage chamber, a screw protruding from the rotating shaft to a lateral side, a paddle protruding from the rotating shaft to a lateral side, and a protrusion protruding from the paddle in the rotating direction;

wherein the paddle includes a first paddle including a first protrusion protruding in the rotating direction, and a second paddle disposed downstream of the first paddle in a conveying direction of the developer and including a second protrusion protruding in the rotating direction, and the position of the second protrusion in the height direction of the second paddle is lower than the position of the first protrusion in the height direction of the first paddle.

16. The method of processing a developer according to claim 15, further comprising:

conveying the developer from the first opening portion to the second opening portion using the paddle inclined with respect to the central axis line.

17. The method of processing a developer according to claim 16, wherein the paddle is inclined with respect to the central axis line at a smaller angle than the screw.

18. The method of processing a developer according to claim 16, wherein the paddle is inclined with respect to the central axis line at an acute angle.

19. The method of processing a developer according to claim 17, wherein the paddle is inclined with respect to the central axis line at an acute angle.

* * * * *